US007143743B2

(12) United States Patent
Uda et al.

(10) Patent No.: US 7,143,743 B2
(45) Date of Patent: Dec. 5, 2006

(54) VALVE POSITION CONTROLLER

(75) Inventors: Toshiaki Uda, Nisikamo-gun (JP); Tsuyoshi Kanda, Obu (JP); Taisuke Murata, Obu (JP); Hiroshi Nakamura, Nishio (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/168,758

(22) Filed: Jun. 29, 2005

(65) Prior Publication Data

US 2006/0016427 A1 Jan. 26, 2006

(30) Foreign Application Priority Data

Jul. 20, 2004 (JP) ..... 2004-212218

(51) Int. Cl.
*F02D 11/00* (2006.01)
*F02D 9/00* (2006.01)

(52) U.S. Cl. ..... 123/399; 123/403

(58) Field of Classification Search ..... 123/399, 123/396, 402, 403, 336, 337, 350, 360, 361
See application file for complete search history.

(56) References Cited

U.S. PATENT DOCUMENTS 4,546,736 A * 10/1985 Moriya et al. ..... 123/179.16
4,735,114 A * 4/1988 Satoh et al. ..... 477/43
4,854,283 A * 8/1989 Kiyono et al. ..... 123/361
5,163,400 A * 11/1992 Yoshioka et al. ..... 123/361
6,465,974 B1 * 10/2002 Watanabe ..... 318/254
2002/0043242 A1 * 4/2002 Ikeda et al. ..... 123/396

FOREIGN PATENT DOCUMENTS

JP H06-94151 4/1994

* cited by examiner

*Primary Examiner*—Mahmoud Gimie
(74) *Attorney, Agent, or Firm*—Nixon & Vanderhye P.C.

(57) ABSTRACT

The throttle position corresponding to the rotational angle of the throttle valve is calculated based on electric signals output from a rotor position detector constituted by three Hall ICs that detect the rotational position of a magnet rotor of a brushless DC motor. A valve position control quantity of the throttle valve is so calculated as to eliminate the difference between the thus calculated valve position and a target valve position. The motor current control quantity of the brushless DC motor is so determined as to eliminate the difference between the calculated valve position and the target valve position. Though the throttle position sensor is omitted, the electric signals output from the rotor position detector are used for calculating both the valve position control quantity and the motor current control quantity.

17 Claims, 12 Drawing Sheets

FIG. 4A
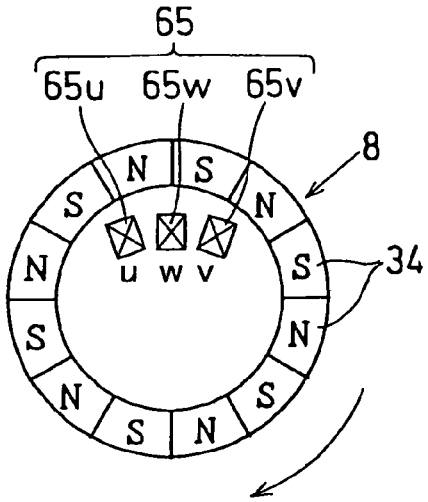
FIG. 4B
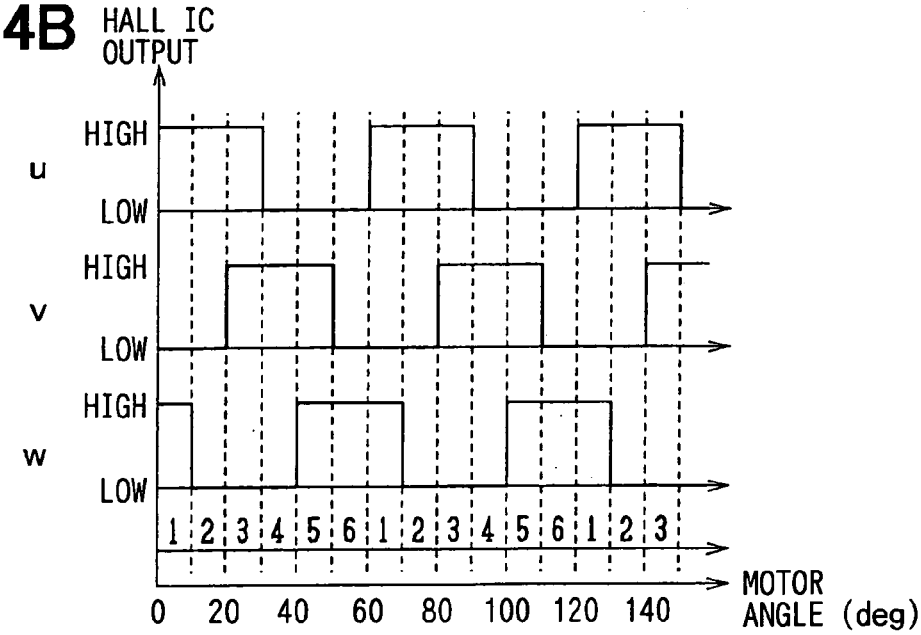
FIG. 4C
| HALL IC OUTPUT | u | v | w |
|---|---|---|---|
| 1 | 1 | 0 | 1 |
| 2 | 1 | 0 | 0 |
| 3 | 1 | 1 | 0 |
| 4 | 0 | 1 | 0 |
| 5 | 0 | 1 | 1 |
| 6 | 0 | 0 | 1 |
1: HIGH 0: LOW

| HALL IC OUTPUT | u | v | w |
|---|---|---|---|
| 1 | 1 | 0 | 1 |
| 2 | 1 | 0 | 0 |
| 3 | 1 | 1 | 0 |

1: HIGH 0: LOW

| HALL IC OUTPUT | u | v | w |
|---|---|---|---|
| 1 | 1 | 0 | 1 |
| 2' | 0 | 0 | 0 |
| 3 | 1 | 1 | 0 |

1: HIGH 0: LOW

| HALL IC OUTPUT | u | v | w |
|---|---|---|---|
| 1 | 1 | 0 | 1 |
| 2 | 1 | 0 | 0 |
| 3 | 1 | 1 | 0 |
| 4 | 0 | 1 | 0 |
| 5 | 0 | 1 | 1 |
| 6 | 0 | 0 | 1 |

1: HIGH 0: LOW

| HALL IC OUTPUT | u | v | w | w' | CONDITION IN CASE OF "w" MALFUNCTION |
|---|---|---|---|---|---|
| 1 | 1 | 0 | 1 | 1 | A |
| 2 | 1 | 0 | 0 | 1 | |
| 3 | 1 | 1 | 0 | 1 | B |
| 4 | 0 | 1 | 0 | 1 | C |
| 5 | 0 | 1 | 1 | 1 | |
| 6 | 0 | 0 | 1 | 1 | D |

1: HIGH 0: LOW

VALVE POSITION CONTROLLER

CROSS-REFERENCE TO RELATED APPLICATION

This application is based on Japanese Patent Application No. 2004-212218 filed on Jul. 20, 2004, the disclosure of which is incorporated herein reference.

FIELD OF THE INVENTION

The present invention relates to a valve position controller for controlling the position of a valve based on a rotational position of a magnet rotor of a brushless motor. In particular, the invention relates to a valve position controller for controlling the position of a throttle that corresponds to the rotational angle of a throttle valve by driving the brushless motor in response to the amount that the accelerator is operated by a driver.

BACKGROUND OF THE INVENTION

There have heretofore been proposed electronically controlled throttle position controllers for electronically controlling the position of a throttle valve by driving a brushless DC motor depending upon the amount that the accelerator pedal is depressed (see, for example, JP-A-6-94151 and Japanese Patent No. 3070292). According to these devices, a motor driving current is supplied to three-phase stator coils wound on a stator core of a brushless DC motor in response to an accelerator position signal output from an accelerator position sensor that detects the amount that the accelerator pedal is depressed (accelerator position) to drive the brushless DC motor, whereby the position of the throttle valve is controlled, and the air is taken in by an amount that is controlled to be an optimum amount by the combustion chambers in the cylinders of the engine. The throttle position controller includes, as shown in FIG. 20, a throttle position sensor (e.g., Hall IC, etc.) 101 that detects the throttle position corresponding to the rotational angle of the throttle valve in order to control the position of the throttle valve. The throttle position controller, further, includes a rotor position detector (e.g., Hall IC, etc.) 104 for detecting the rotational position of the magnet rotor in order to control the position of the magnet rotor having field poles constituted by a plurality of permanent magnets relative to the three-phase stator coils 103.

A valve position controller 105 controls the position of the throttle valve so that there is no deviation in position between the throttle position signal output from the throttle position sensor 101 and the accelerator position signal output from the accelerator position sensor 102. The rotor position detector 104 further transmits the data to a motor driver 107 through a rotor position detector 106 so as to vary the amount of motor driving current to the three-phase stator coils 103 and to vary the direction of the current. The rotor position detector 106 detects the position of the magnet rotor relative to the three-phase stator coils 103, so determines the motor driving current selectively fed to the two phases of the three-phase stator coils 103 that the magnet rotor produces a maximum output torque depending upon the detected result and, further, determines the direction of the motor driving current fed to the three-phase stator coils 103.

However, the above throttle position controllers include the throttle position sensor 101 for controlling the position of the throttle valve in addition to including the rotor position detector 104 for controlling the position of the magnet rotor relative to the stator coils 103 and the rotor position detector 106, posing a problem of an increased number of parts and boosting up the cost.

SUMMARY OF THE INVENTION

It is an object of the present invention to provide a valve position controller which is capable of decreasing the number of parts and the cost by using the signals output from the rotor position detector for calculating both the valve position control quantity and the motor current control quantity, omitting the throttle position (valve position) sensor.

According to the present invention, the present position of the valve is calculated (estimated) based on the signals corresponding to the rotational position of the magnet rotor relative to the stator coil of the three-phase brushless motor, that are output from the rotor position detector. A valve position control quantity is calculated so as to eliminate the difference between the present valve position that is calculated and a control target value, and a motor current control quantity is calculated based on the valve position control quantity that is calculated. Among the stator coils of the three phases, the stator coils of two phases are selectively driven based on the signals corresponding to the rotational position of the magnet rotor relative to the three-phase stator coils of the brushless motor output from the rotor position detector and on the motor current control quantity that is calculated. Namely, the magnet rotor of the brushless motor rotates and the present position of the valve is brought close to the target control value. Though the throttle position (valve position) sensor is omitted, the signals output from the rotor position detector are used for calculating both the valve position control quantity and the motor current control quantity making it possible to decrease the number of parts and the cost.

BRIEF DESCRIPTION OF THE DRAWINGS

FIG. 4A is a view schematically illustrating a positional relationship between the magnet rotor and the three Hall ICs, FIG. 4B is a timing chart illustrating the outputs of the three Hall ICs relative to the rotational angle of the motor, and FIG. 4C is a diagram illustrating the outputs of the three Hall ICs relative to the rotational angle of the motor (first embodiment);

DESCRIPTION OF THE PREFERRED EMBODIMENTS

First Embodiment

Figure 1:
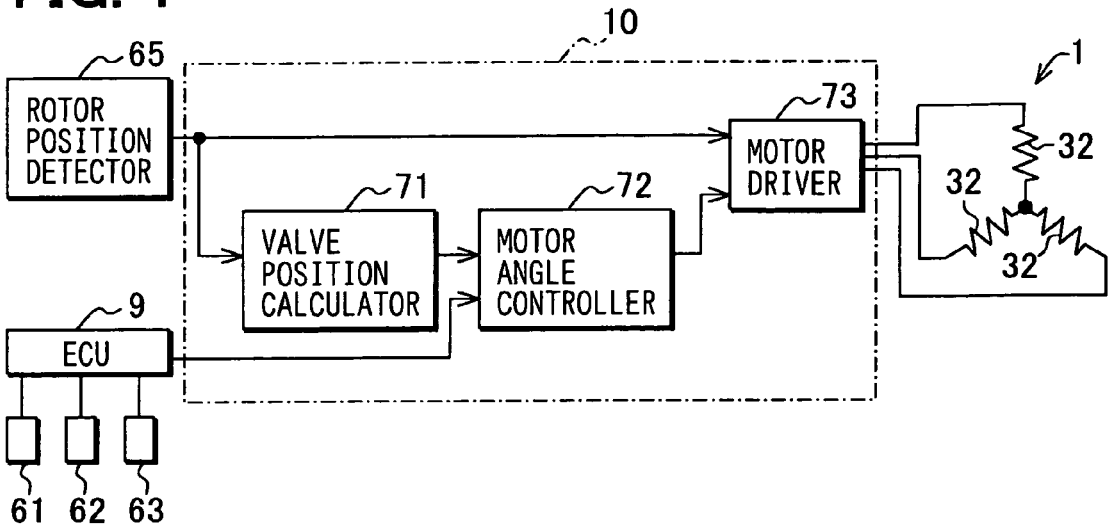
FIG. 1 is a diagram of constitution illustrating a control logic of a motor current control circuit (first embodiment)
Figure 2:
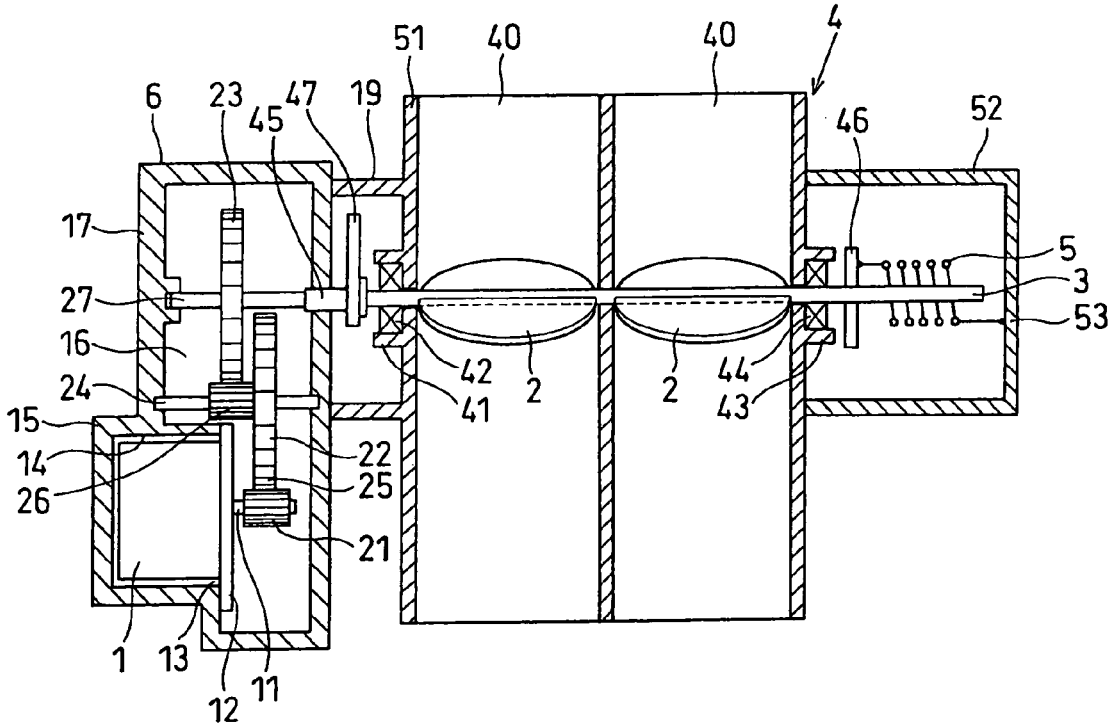
FIG. 2 is a sectional view schematically illustrating the constitution of a valve position controller for an internal combustion engine (first embodiment)
Figure 3A:
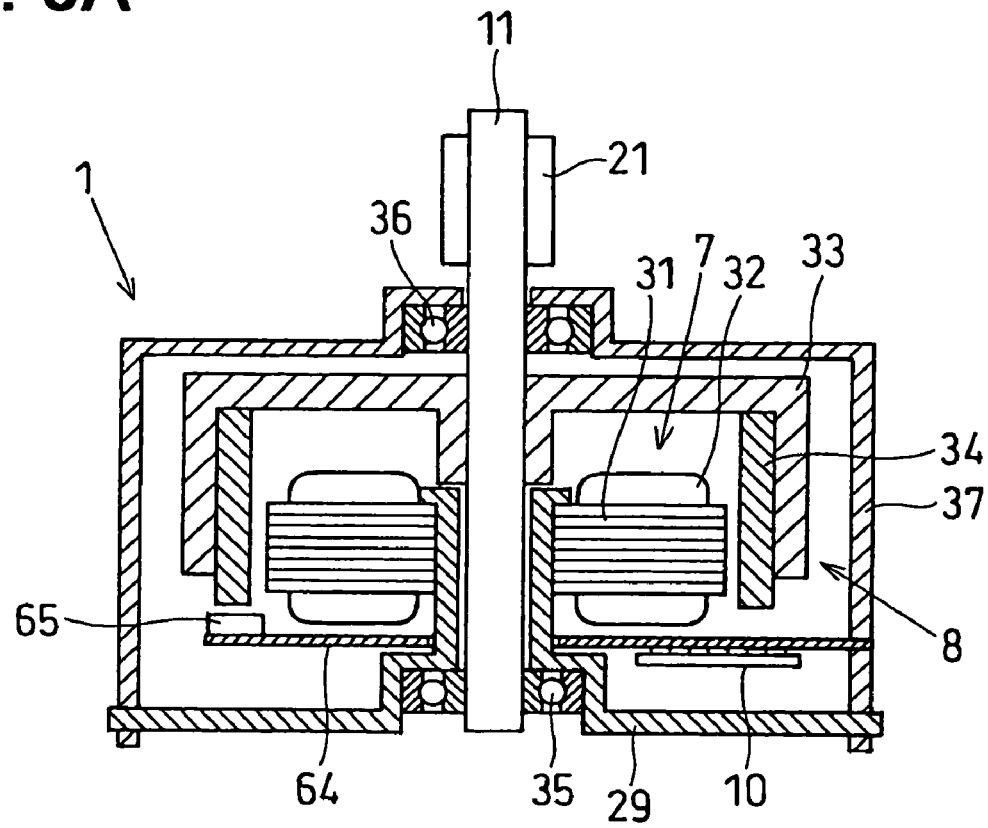
FIG. 3A is a sectional view schematically illustrating the constitution of a brushless DC motor.

FIGS. 1 to 7 illustrate a first embodiment of the present invention, wherein FIG. 1 is a diagram illustrating a control logic of a motor current control circuit, FIG. 2 is a view schematically illustrating the constitution of a valve position controller for an internal combustion engine, and FIG. 3A is a view schematically illustrating the constitution of a brushless DC motor.

The valve position controller for an internal combustion engine according to this embodiment is a throttle position controller for the internal combustion engine, which is provided in the intake system of the internal combustion engine such as a multi-cylinder (four cylinder, in this embodiment) gasoline engine (hereinafter referred to as the engine) mounted on a vehicle such as an automobile, and works to vary the throttle position corresponding to the rotational angle of the throttle valve 2 by driving a brushless DC motor 1 in response to the amount that the accelerator pedal is depressed by an operator (a driver) in order to control the engine rotational speed or the engine torque.

The valve position controller for the internal combustion engine includes double-throw throttle valves 2 for adjusting the amount of the air taken in by the combustion chambers of the cylinders of the engine, a valve shaft 3 that turns together with the throttle valves 2, a throttle body 4 for rotatably supporting the valve shaft 3, a power unit for driving the double-throw throttle valves 2 in a direction of opening the valves or in a direction of closing the valves, a return spring 5 for urging the double-throw throttle valves 2 in a direction of closing the valves (or in a direction of opening the valves), and an engine control unit (hereinafter referred to as ECU) 9 for electronically controlling a drive unit (specifically, a brushless DC motor 1) based on sensor signals from various sensors.

The power unit of this embodiment includes a brushless DC motor 1 which is a drive source, and a reduction gear mechanism which reduces the rotational speed of a motor shaft (output shaft) 11 of the brushless DC motor 1 at a predetermined reduction ratio, which are contained in an actuator casing 6 integrally assembled on an outer wall portion of the throttle body 4. The brushless DC motor 1 is an electric actuator which, when energized, causes the motor shaft 11 to rotate in a forward direction or in a reverse direction. A front end frame 12 is fastened and fixed to the surrounding of a motor insertion port 13 of the actuator casing 6 by using fastening fittings (not shown) such as fastening screws. The actuator casing 6 includes a motor housing portion 15 forming a motor-containing hole 14 where the brushless DC motor 1 is contained and held, and a gear housing portion 17 forming a gear chamber 16 where gears are rotatably held to constitute the reduction gear mechanism. The actuator casing 6 is integrally assembled at an end of a cylindrical wall portion 19 of the throttle body 4 on the opening side.

The reduction gear mechanism is constituted by a pinion gear 21 fixed to the outer periphery of the motor shaft 11 of the brushless DC motor 1, an intermediate reduction gear 22 that turns in mesh with the pinion gear 21, and a valve gear 23 that turns in mesh with the intermediate reduction gear 22. The reduction gear mechanism is used as a power transmission mechanism (torque transmission part) for transmitting the rotational power of the brushless DC motor 1 (motor output shaft torque) to the double-throw throttle valves 2 via the valve shaft 3. The pinion gear 21 is a motor gear that rotates integrally with the motor shaft 11 of the brushless DC motor 1. The intermediate reduction gear 22 is rotatably fitted to the outer periphery of a support shaft 24 which is a center of rotation. The intermediate reduction gear 22 has a large gear 25 that is brought in mesh with the pinion gear 21, and a small gear 26 that is brought in mesh with the valve gear 23. The valve gear 23 is fixed to the outer periphery of the valve shaft 3 at one end thereof in the axial direction.

Referring, here, to FIG. 3, the brushless DC motor 1 is, for example, a three-phase full-wave drive brushless motor, i.e., an outer rotor-type permanent magnet field brushless motor which includes an inner stator 7 fixed to a bearing holder (motor end frame) 29 and an outer rotor (hereinafter referred to as magnet rotor) 8 disposed on the outer peripheral side of the inner stator 7 maintaining a predetermined gap.

The inner stator 7 is constituted by a stator core (armature core) 31 which is a laminated core obtained by laminating a number of soft magnetic materials (e.g., steel plates or silicon steel plates), and the three-phase coils (armature windings) 32 wound on the stator core 31. A plurality of teeth are formed maintaining an equal pitch in the outer peripheral portion of the stator core 31. On each tooth, there are wound the stator coils 32 of each of the U-phase, V-phase and W-phase in a concentrated manner. The stator coils 32 of the three phases are Y-connected. The stator coils 32 of the three phases, however, may be delta-connected.

The magnet rotor 8 is constituted by a rotor core 33 that fits to the outer periphery of the motor shaft 11, and twelve permanent magnets 34 fixed to the inner periphery of the rotor core 33 by using an adhesive. One end (lower end in the drawing) of the motor shaft 11 integral with the magnet rotor 8 is rotatably supported by a bearing holder 29 through a bearing 35, and the other end (upper end in the drawing) of the motor shaft 11 is rotatably supported by a cylindrical housing (motor housing) 37 via a bearing 36.

Figure 3B:
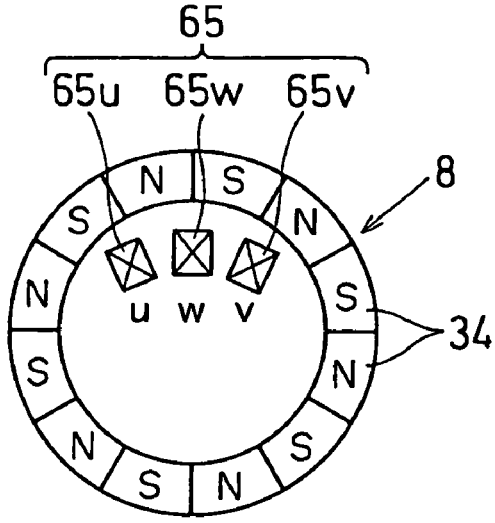
FIG. 3B is a view schematically illustrating a positional relationship between the magnet rotor and three Hall ICs (first embodiment)

Here, referring to FIGS. 3A, 3B and 4A, the permanent magnets 34 according to this embodiment rotate accompanying the rotation of the magnet rotor 8 which is to be measured, have magnetized surfaces that are formed in an arcuate shape so as to face the outer peripheral surface of the inner stator 7, and are arranged to constitute 12 poles alternately repeating the N-pole and the S-pole along the inner periphery in the direction of the plate thickness. That is, the twelve permanent magnets 34 have their N-pole and S-pole magnetized in parallel in a manner that the polarities are opposite to each other at both ends (inner peripheral portion and outer peripheral portion) in the direction of the plate thickness. The permanent magnets 34 are rare earth magnets, such as samarium-cobalt (Sm—Co) magnets or neodium (Nd) magnets, or alnico magnets or ferrite magnets, assuming the shape of arcuate plates that continue to generate the magnetic force for extended periods of time maintaining stability. As the permanent magnets 34, there can be further used resin magnets obtained by sintering a polyamide resin (PA), neodium (Nd), iron (Fe) and boron (B) powder.

The double-throw throttle valves 2 comprise circular disks fixed to the outer periphery of the valve shaft 3 or integrally formed together therewith having centers at points where the center axes of the throttle bores (intake passages) 40 of a circular shape in cross section intersect the center axis of rotation of the valve shaft 3. These throttle valves 2 are rotary valves having center axes of rotation in a direction nearly at right angles with the axial direction of an average flow of the intake air flowing through the throttle bores 40 in the throttle body 4. The throttle valves 2 change their rotational angle (valve position) over a rotational angular range of from the fully closed position where the amount of the intake air is a minimum through up to a fully opened position where the amount of the intake air is a maximum, to control the amount of the air taken into the combustion chambers of the cylinders of the engine. The double-throw throttle valves 2 are urged by the return spring 5 in a direction in which they are brought to the fully closed position (or in a direction in which they are brought to the fully opened position).

The valve shaft 3 constitutes the rotary axis of the double-throw throttle valves 2 and is defining the direction of the center of rotation (axial direction) which is nearly at right angles with the axial direction of the average flow of the intake air flowing through the throttle bores 40 in the throttle body 4, but is in parallel with the direction of center of the motor housing portion 15 in which the brushless DC motor 1 is fixed. One end of the valve shaft 3 in the axial direction works as a first bearing slide portion which rotatably slides in a first slide hole of a first bearing 42 held and fixed to a first bearing boss portion 41 of the throttle body 4. The other end of the valve shaft 3 in the axial direction works as a second bearing slide portion which rotatably slides in a second slide hole of a second bearing 44 held and fixed to a second bearing boss portion 43 of the throttle body 4.

A cylindrical joint portion (torque transmission part) 45 is integrally formed at one end of the valve shaft 3 in the axial direction thereof. A valve-side spring hook (first engaging portion) 46 is integrally attached to the other end of the valve shaft 3 in the axial direction to anchor one end of the return spring 5. A rotational angle limiting member 47 is integrally provided on the outer peripheral portion of the joint portion 45. On the outer peripheral portion of the rotational angle limiting member 47, there are integrally formed a full close stopper portion (not shown) which is a to-be-engaged portion that comes into direct or indirect contact with a full close-side mechanical stopper (full close stopper, see FIG. 17) 91 when the double-throw throttle valves 2 are brought to the fully closed position, and a full open stopper portion (not shown) which is a to-be-engaged portion that comes into direct or indirect contact with a full open-side mechanical stopper (full open stopper, see FIG. 17) 92 when the double-throw throttle valves 2 are brought to the fully opened position. The two mechanical stoppers 91 and 92 are integrally formed on the inner peripheral portion of the cylindrical wall portion 19 integrally formed on the outer wall of the throttle body 4.

At one end of the joint portion 45 in the axial direction, there is provided a protruded fitting portion that fits (loose fits) to a recessed fitting groove of the rotary shaft 27 of the valve gear 23 which is one of the constituent elements of the reduction gear mechanism. In this embodiment, a straight protruded portion is formed on the fitting portion of the joint portion 45 and a straight recessed portion is formed in the fitting groove of the rotary shaft 27 of the valve gear 23 in order to maintain a predetermined relative angle among the double-throw throttle valves 2, the valve shaft 3 and the valve gear 23, and to prevent a relative rotation between the valve shaft 3 and the valve gear 23.

The throttle body 4 is a throttle housing (valve housing) having two throttle bore walls 51 holding, therein, the double-throw throttle valves 2 so as to be opened and closed and permitting the air to flow in the center axial direction as it is taken in by the combustion chambers of the cylinders of the engine. The throttle body 4 is forming throttle bores 40 of a circular shape in cross section in the throttle bore walls 51 thereof permitting the intake air to flow into the combustion chambers in the cylinders of the engine. Namely, the throttle body 4 is a device which holds the double-throw throttle valves 2 so as to rotate over a range of from the fully closed position where the amount of the intake air is a minimum through up to the fully opened position where the amount of the intake air is a maximum. The throttle body 4 is fastened and fixed to the intake manifold of the engine or to the surge tank by using fastening fittings (not shown) such as fixing bolts or fastening screws.

The throttle bores 40 are provided with an air inlet portion for taking in the air from an air cleaner through the engine intake pipe and an air outlet portion for flowing the intake air into the intake manifold of the engine or into the surge tank.

The return spring 5 is contained in a spring housing portion 52 integrally attached to the outer wall of the throttle bore wall 51 of the throttle body 4, and is wound on the outer periphery at the other end of the valve shaft 3 in the axial direction. One end of the return spring 5 is held (or anchored) by the valve-side spring hook 46 of the valve shaft 3, and the other end of the return spring 5 is held (or anchored) by a housing-side spring hook (second engaging portion) 53 provided on the inner wall surface of the spring housing portion 52.

Referring to FIG. 1, the ECU 9 of this embodiment includes a known microcomputer which is constituted by a CPU which executes the control processing and operation processing, a storage unit (memory such as ROM or EEPROM, or RAM or standby RAM) for storing various programs and data, an input circuit, an output circuit, a power source circuit, etc., as well as a motor current control circuit 10 for feeding a motor drive current to the three-phase stator coils 32 of the brushless DC motor 1. The microcomputer and the motor current control circuit 10 in the ECU 9 are controlled by feedback so that, when the ignition switch is turned on (IG ON), the amount of the intake air, for example, is transformed into a control instruction value based on the control program stored in the memory and on the control logic.

The microcomputer is so constituted that the sensor signals from various sensors such as an accelerator position sensor 61 for detecting the amount the accelerator pedal is depressed by the driver (amount the accelerator pedal is operated), an air flow meter (intake air amount sensor) 62 for detecting the amount of the air taken in by the engine, and a crank angle sensor 63 for detecting the rotational angle of the crankshaft of the engine, are put to the A/D conversion through an A/D converter, and are input to the microcomputer. Here, the microcomputer works as means for detecting the rotational speed of the engine by measuring the time interval of NE pulse signals output from the crank angle sensor 63.

The motor current control circuit 10 is mounted on a circuit board 64 incorporated in the cylindrical housing 37 of the brushless DC motor 1. The motor current control circuit 10 is so constituted as to receive electric signals output from a rotor position detector 65 that detects the rotational position (rotor position) of the magnet rotor 8 of the brushless DC motor 1. Further, the motor current control circuit 10 is a drive IC integrating, on a one-chip microcomputer, the functions of a valve position calculator (valve position calculation means) 71, a motor angle controller (control quantity calculation means) 72 and a motor driver (motor driver circuit) 73, and is integrally mounted on the circuit board 64 on the side opposite to the side of the magnet rotor 8.

Here, the rotor position detector 65 is a rotor rotational position sensor that produces electric signals corresponding to the rotational position of the magnet rotor 8 relative to the three-phase stator coils 32 of the brushless DC motor 1 (rotational position of the magnet rotor 8, rotational angle of the motor) and to the rotational direction of the magnet rotor 8. As shown in FIGS. 1, 3A, 3B, 4A, 4B, and 4C, the rotor position detector 65 is constituted by three Hall ICs 65*u*, 65*v* and 65*w* mounted on the circuit board 64 on side of the magnet rotor 8, the circuit board 64 being contained in the cylindrical housing 37 of the brushless DC motor 1. The three Hall ICs 65*u*, 65*v* and 65*w* are arranged maintaining a predetermined interval on the orbital radius of twelve permanent magnets 34 maintaining an interval of, for example, 40 degrees in the direction in which the magnet rotor 8 rotates. The three Hall ICs 65*u*, 65*v* and 65*w* have, respectively, magnetically sensitive surfaces of a predetermined width on both sides thereof in the direction of the plate thickness thereof.

The three Hall ICs 65*u*, 65*v* and 65*w* are the ICs (integrated circuits comprising amplifier circuits and Hall elements (noncontact type magnetic detector elements) that detect the rotational position of the magnet rotor 8 of the brushless DC motor 1 (motor angle) and the direction in which the magnet rotor 8 rotates. The Hall ICs 65*u*, 65*v* and 65*w* generate electromotive forces upon sensing the magnetic field generated by the twelve permanent magnets 34, and produce voltage signals corresponding to the density of magnetic flux intersecting the Hall ICs 65*u*, 65*v* and 65*w*. The three Hall ICs 65*u*, 65*v* and 65*w* may have a function for electrically trimming, from an external unit, programs for adjusting the output gains for the magnetic flux density, for adjusting the offset and for correcting the temperature characteristics and may, further, have a function for self-diagnosing the breakage of the wires and the short-circuit.

The valve position calculator 71 works as valve position calculation means for calculating the throttle position (valve position) corresponding to the rotational angle of the double-throw throttle valves 2 based on the electric signals output from the rotor position detector 65. Concretely, as shown in FIG. 4A to 4C and as represented by the following formulas 1 and 2, the number of shifts of the conditions of the electric signals output from the three Hall ICs 65*u*, 65*v* and 65*w* is counted, and the total rotational angle of the magnet rotor 8 of the brushless DC motor 1 is calculated, i.e., the throttle position (valve position) corresponding to the rotational angle of the double-throw throttle valves 2 is calculated. Namely, based on the counted number of when the reference position is being learned, the valve position counter (Cv) is increased or decreased depending upon the direction of shift of the condition. When the condition is shifted in the next turn, the valve position counter (Cv) is increased by one. For example, an increase is made like 1→2, 2→3, 3→4, 4→5, 5→6 or 6→1. Further, when the condition is shifted in the next turn, the valve position counter (Cv) is decreased by one. For example, a decrease is made like 1→6, 6→5, 5→4, 4→3, 3→2 or 2→1.

$$\text{Valve position} = \text{counted number (times)} \times (360\ [\text{deg}] / \text{number of magnetic poles } P / \text{gear ratio } N)$$

$$\text{Valve position resolution} = 360[\text{deg}] / \text{number of magnetic poles } P / \text{gear ratio } N$$

In this embodiment, a relationship P/N>360/5=72 is maintained so that the resolution is not larger than 5 degrees.

The motor angle controller 72 has a function for calculating a valve position control quantity based upon a deviation in position between a target control value (target throttle position, target valve position, control instruction value) set depending upon the engine operating conditions and a real throttle position (valve position that is calculated) so as to eliminate the deviation in position. The motor angle controller 72, further has a function for calculating the motor current control quantity based on the valve position control quantity that is calculated.

Here, the valve position control quantity is calculated based on a target throttle position (target valve position) or a target valve position thereof calculated by the ECU 9 relying on the real throttle position (calculated valve position), engine rotational speed and accelerator position signal (by taking the deflection of the torque transmission part into consideration) in accordance with a proportional integration/differentiation control (PID control) so as to eliminate the difference from the target valve position corrected by the motor angle controller 72. The motor current control quantity includes an output duty (amount of current) calculated as a duty ratio signal that is PWM-converted (pulse-modulated) so as to eliminate the deviation between the target valve position and the real throttle position (calculated valve position), and the direction of motor drive current flowing into the stator coils 32 of two phases among the stator coils 32 of the three phases.

The motor driver 73 has a function of forming an output current duty (motor drive current) from the output duty (amount of current) set by the electric signals from the rotor position detector 65, i.e., from the three Hall ICs 65*u*, 65*v* and 65*w* and by the motor angle controller 72, and selectively drives the stator coils 32 of two phases among the stator coils 32 of the three phases. The motor driver 73 has semiconductor switching elements for selectively changing over the direction of feeding the motor drive currents to the stator coils 32 of two phases among the stator coils 32 of the three phases.

Control Method of the First Embodiment

Figure 5:
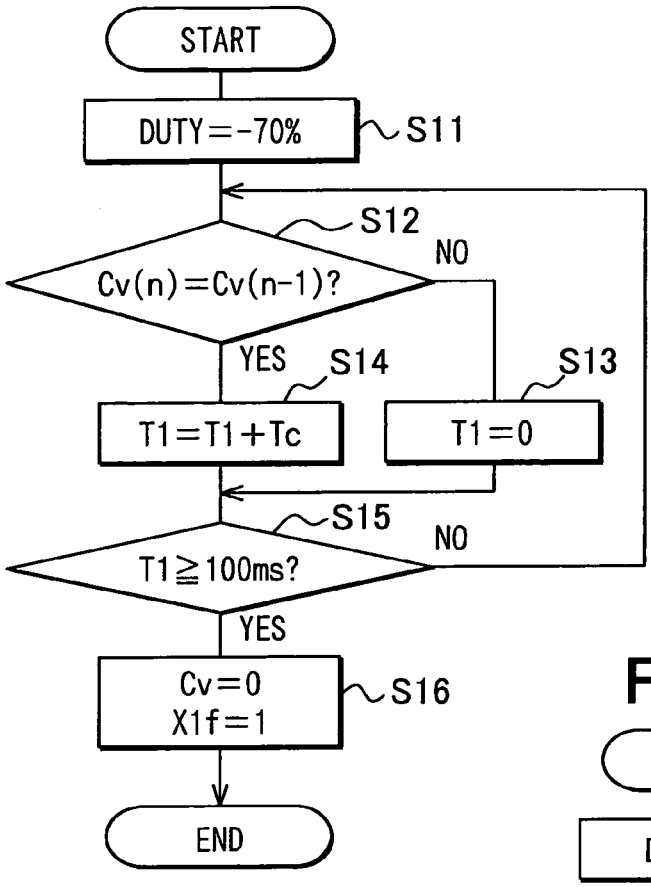
FIG. 5 is a flowchart illustrating a procedure of processing a reference position learn control (first embodiment)
Figure 6:
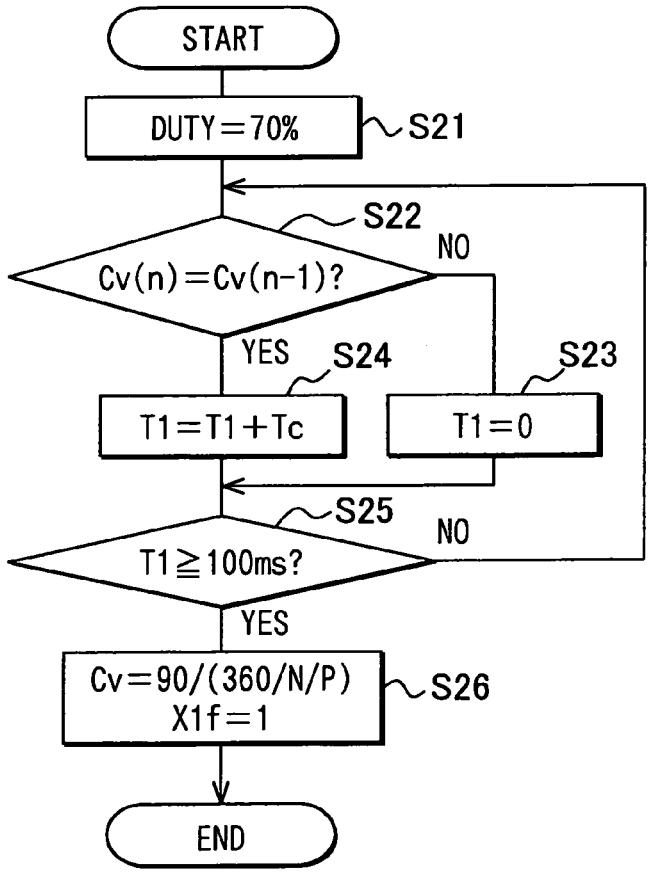
FIG. 6 is a flowchart illustrating a procedure of processing a reference position learn control (first embodiment)

Next, a method of controlling the valve position controller for an internal combustion engine according to the embodiment will be briefly described with reference to FIGS. 1 to 7. A procedure for processing a reference position learn control executed by the valve position calculator (valve position calculation means) 71 will be described by using flowcharts of FIGS. 5 and 6. Here, either one of the reference position learn control routines of FIGS. 5 and 6 is executed every time when the ignition switch is turned on (IG ON) with the select lever in the parking (P) range or in the neutral (N) range. If the sensor outputs from the three Hall ICs 65*u*, 65*v* and 65*w* are malfunctioning, if the power transmission mechanism including the gear reduction mechanism is malfunctioning or if the valve position calculator 71 is malfunctioning, the valve position calculator 71 of this embodiment has been so constituted as to execute the routine again (re-learning) provided the traveling speed of the vehicle is smaller than a predetermined value (e.g., 0 km/h) with the select lever in the parking (P) range or in the neutral (N) range.

First, at the time of the fully closed learn control (fully closed=0°), the PWM-converted (pulse-modulated) duty ratio is set to be the current duty ratio (e.g., −70%) at the time of the fully closed learn control to maintain the double-throw throttle valves 2 at the fully closed position at step S11 in FIG. 5. Next, in order to make sure that the double-throw throttle valves 2 and the magnet rotor 8 are not moving from the fully closed position, it is determined if the valve position counter Cv (n) has the value same as the value Cv (n−1) of the last time at step. When the determined result is NO, the learning time counter (T1) is reset to 0 at step S13. Thereafter, the routine proceeds to a judging processing at step S15.

When the determined result is YES at step S12, the learning time counter (T1) is counted up by a sampling time (Tc) at step S14. Next, it is determined if the learning time counter (T1) is greater than the learning end time (e.g., 100 msec) at step S15. When the determined result is NO, the routine returns back to the judging processing of step S12. When the determined result at step S15 is YES, the valve position counter (Cv) is set to the throttle position=valve position 0 that corresponds to the fully closed position of the double-throw throttle valves 2, and the learn end flag (X1f) is set to 1 at step S16. Thereafter, the reference position learn control routine of FIG. 5 ends.

At the time of the fully opened learn control (fully opened=90°), the PWM-converted (pulse-modulated) duty ratio is set to be the current duty ratio (e.g., 70%) at the time of the fully opened learn control to maintain the double-throw throttle valve 2 at the fully opened position at step S21 in FIG. 6. Next, in order to make sure that the double-throw throttle valves 2 and the magnet rotor 8 are not moving from the fully opened position, it is determined if the valve position counter Cv (n) has the value same as the value Cv (n−1) of the last time at step S22. When the determined result is NO, the learning time counter (T1) is reset to 0 at step S23. Thereafter, the routine proceeds to a judging processing at step S25.

When the determined result is YES at step S22, the learning time counter (T1) is counted up by a sampling time (Tc) at step S24. Next, it is determined if the learning time counter (T1) is greater than the learning end time (e.g., 100 msec) at step S25. When the determined result is NO, the routine returns back to the judging processing of step S22. When the determined result at step S25 is YES, the valve position counter (Cv) is set to the throttle position=valve position 90/(360/gear ratio N/number of magnetic poles P) that corresponds to the fully opened position of the double-throw throttle valves 2, and the learn end flag (X1f) is set to 1 at step S26. Thereafter, the reference position learn control routine of FIG. 6 ends.

Figures 7, 8A, 8B:
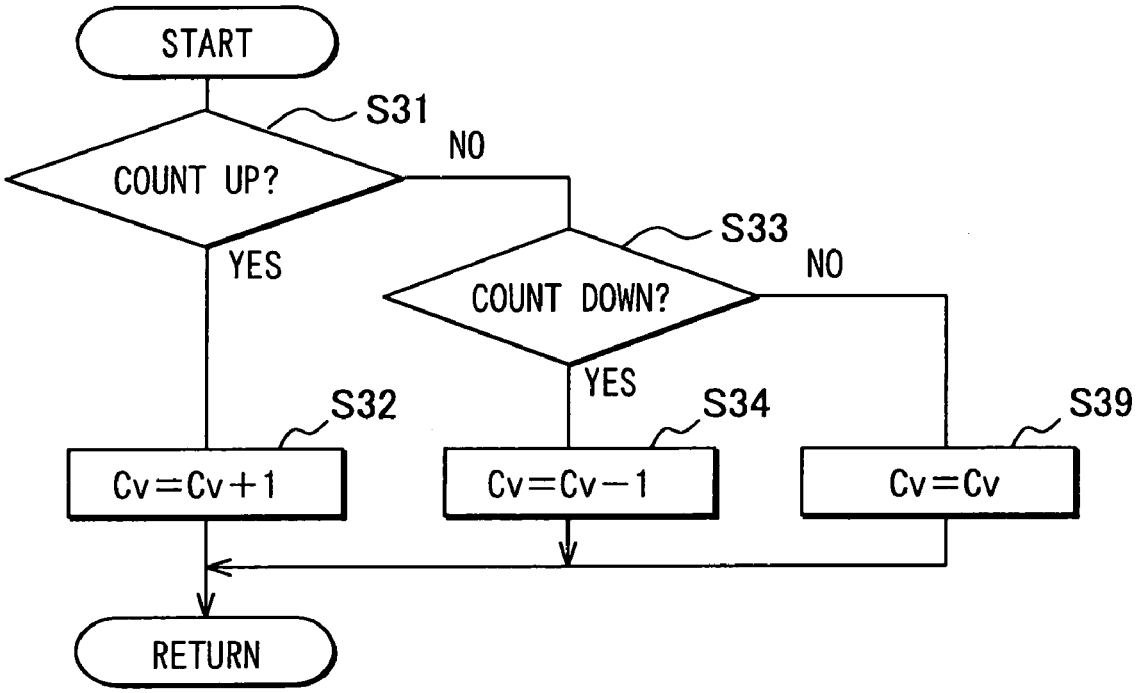
FIG. 7 is a flowchart illustrating a procedure of processing a valve position calculation (first embodiment)
FIG. 8A is a diagram illustrating the outputs of the Hall ICs during the normal operation.
FIG. 8B is a diagram illustrating the outputs of the Hall ICs during the operation which is temporarily malfunctioning due to noise or the like (second embodiment)

A procedure for processing the valve position calculation executed by the valve position calculator (valve position calculation means) 71 will be described by using a flowchart of FIG. 7. The valve position calculation routine of FIG. 7 is repetitively executed at every predetermined timing after the ignition switch is turned on (IG ON). Further, the valve position calculation routine of FIG. 7 starts when the learn end flag (X1f) is 1.

First, it is determined if the count-up condition is holding at step S31. The count-up condition holds when the signal conditions (ssta) output from the rotor position detector 65 vary as described below, i.e., when the electric signals output from the three Hall ICs 65*u*, 65*v* and 65*w* vary as described below. The count-up condition does not hold in other cases. Namely, the count-up condition holds when the signals vary in a manner of 1→2, 2→3, 3→4, 4→5, 5→6 or 6→1.

When the determined result at step S31 is YES, the valve position counter (Cv) is counted up at step S32. The procedure, thereafter, goes out of the valve position calculation routine of FIG. 7. When the determined result at step S31 is NO, it is determined whether the count-down condition is holding at step S33. The count-down condition holds when the signal conditions (ssta) output from the rotor position detector 65 vary as described below, i.e., when the electric signals output from the three Hall ICs 65*u*, 65*v* and 65*w* vary as described below. The count-down condition does not hold in other cases. Namely, the count-down condition holds when the signals vary in a manner of 1→6, 6→5, 5→4, 4→3, 3→2 or 2→1.

When the determined result at step S33 is YES, the valve position counter (Cv) is counted down at step S34. The procedure, thereafter, goes out of the valve position calculation routine of FIG. 7. When the determined result at step S33 is NO, the valve position counter (Cv) is not changed. Namely, the present valve position counter (Cv) is maintained at step S39. Thereafter, the procedure goes out of the valve position calculation routine of FIG. 7.

Operation of the First Embodiment

The operation of the valve position controller for an internal combustion engine according to the embodiment will now be briefly described with reference to FIGS. 1 to 7.

When the driver depresses the accelerator pedal, an accelerator position signal is input to the ECU 9 from the accelerator position sensor 61. The ECU 9 sends a target control value (target throttle position) to the motor current control circuit 10. On the other hand, the valve position calculator 71 counts the number of shifts of the conditions of the electric signals corresponding to the rotational position of the magnet rotor 8 relative to the three-phase stator coils 32 of the brushless DC motor 1 output from the rotor position detector 65, i.e., counts the number of shifts of the conditions of the electric signals output from the three Hall ICs 65*u*, 65*v* and 65*w*, and calculates the total rotational angle of the magnet rotor 8 of the brushless DC motor 1, i.e., calculates the throttle position corresponding to the rotational angle of the double-throw throttle valves 2.

Next, the motor angle controller 72 calculates the valve position control quantity based on a target throttle position (target valve position) or a target valve position thereof calculated by the ECU 9 relying on the real throttle position (calculated valve position), engine rotational speed and accelerator position signal (by taking the deflection of the torque transmission part into consideration) in accordance with a proportional integration/differentiation control (PID control) so as to eliminate the difference from the target valve position corrected by the motor angle controller 72. Further, the motor angle controller 72 determines an output duty (amount of current) calculated as a duty ratio signal that is PWM-converted (pulse-modulated) so as to eliminate the deviation between the target control value (target throttle position) and the real throttle position (calculated valve position), and the direction of motor driving current flowing into the stator coils 32 of two phases among the stator coils 32 of the three phases.

Next, the motor driver 73 forms an output current duty (motor driving current) from the output duty (amount of current) set by the electric signals output from the rotor position detector 65, i.e., from the three Hall ICs 65*u*, 65*v* and 65*w* and by the motor angle controller 72, and selectively drives the stator coils 32 of two phases among the stator coils 32 of the three phases. Here, the motor driver 73 selectively changes over the direction of feeding the motor driving currents to the stator coils 32 of two phases among the stator coils 32 of the three phases.

Thus, the motor driving current flows to the stator coils 32 of two phases among the stator coils 32 of the three phases of the brushless DC motor 1, and the motor shaft 11 of the brushless DC motor 1 turns so that the double-throw throttle valves 2 are turned by a predetermined angle. The torque of the brushless DC motor 1 is transmitted to the pinion gear 21, intermediate reduction gear 22 and valve gear 23. Therefore, the valve gear 23 and the valve shaft 3 coupled to the rotary shaft 27 of the valve gear 23 through the joint portion 45, are turned by a rotational angle corresponding to the amount the accelerator pedal is depressed against the urging force of the return spring 5 (e.g., against the urging force in the direction of fully closing the valves). Therefore the double-throw throttle valves 2 are turned in a direction in which they are opened (fully opening direction) toward the fully opened position from the fully closed position, and the throttle bores 40 of the throttle body 4 are opened by a predetermined valve position, causing the engine rotational speed to change into a speed corresponding to the amount the accelerator pedal is depressed.

Effect of the First Embodiment

In the valve position controller for the internal combustion engine according to this embodiment as described above, the throttle position corresponding to the rotational angle of the double-throw throttle valves 2 is calculated based on the signal conditions (ssta) from the rotor position detector 65 that detects the rotational position (motor angle) of the magnet rotor 8 of the brushless DC motor 1 and the rotational direction of the magnet rotor 8, i.e., based on the electric signals output from the three Hall ICs 65*u*, 65*v* and 65*w*. The valve position control quantity for the double-throw throttle valves 2 is so calculated as to eliminate the difference between the real throttle position that is calculated (valve position found by calculation) and the target control value (target valve position, instructed position).

Further, the motor current control quantity for the brushless DC motor 1 is so calculated as to eliminate the difference between the target control value (target throttle position) and the real throttle position (valve position that is calculated). Concretely, there are determined an output duty (amount of current) calculated as a duty ratio signal that is PWM-converted (pulse-modulated) so as to eliminate the deviation between the target control value (target throttle position) and the real throttle position (calculated valve position), and the direction of motor driving current flowing into the stator coils 32 of two phases among the stator coils 32 of the three phases. Despite of omitting the throttle position (valve position) sensor, therefore, the signal conditions (ssta) from the rotor position detector 65 are used, i.e., the electric signals output from the three Hall ICs 65*u*, 65*v* and 65*w* are used for calculating both the valve position control quantity and the motor current control quantity making it possible to decrease the number of parts and the cost.

Here, means for indirectly detecting the valve position of the throttle position controller shown in JP-A-6-94151 and in Japanese Patent No. 3070292, do not directly detect the valve position from the electric signals (sensor outputs) output from a rotor position detector means 104, but indirectly detect the valve position by counting the signals for changing the current control transistor over to the three-phase stator coils 103 determined by a motor current driver 107 based on the sensor output. According to the method of indirectly detecting the valve position, there remains a problem in that the rotation of the throttle valve cannot be detected in case the throttle valve has rotated due to the intake air that flows through the throttle bores (intake passages) of the throttle body when the current is interrupted from flowing into the three-phase stator coils 103 of the brushless DC motor. According to the above method of indirectly detecting the valve position, further, there remains another problem in that the absolute valve position of the throttle valve (relative position from the reference position) cannot be detected.

In the valve position controller for the internal combustion engine according to this embodiment, therefore, the valve position calculator 71 in the motor current control circuit 10 incorporates a valve position counter (Cv) for counting the signal conditions (ssta) output from the rotor position detector 65, i.e., for counting the number of shifts of the conditions of the electric signals output from the three Hall ICs 65*u*, 65*v* and 65*w*. Based on the number counted by the valve position counter (Cv), the valve position calculator 71 calculates the throttle position (valve position) corresponding to the present position (rotational angle) of the double-throw throttle valves 2. This makes it possible to monitor (directly detect), at all times, the signal conditions (ssta) output from the rotor position detector 65, i.e., to monitor the number of shifts of the conditions of electric signals output from the three Hall ICs 65*u*, 65*v* and 65*w*, and to accurately calculate or estimate the throttle position (valve position) at all times. Upon executing the procedure for processing the reference position learn control for the magnet rotor 8 illustrated in the flowcharts of FIGS. 5 and 6, further, the absolute value of the throttle position (valve position)(relative position from the reference position) can be calculated or estimated.

Further, the three functions of the valve position calculator 71, motor angle controller 72 and motor driver 73 are integrated on a one-chip microcomputer, eliminating a wire harness for coupling the valve position calculator 71 to the motor angle controller 72, eliminating a wire harness for coupling the motor angle controller 72 to the motor driver 73, and eliminating the transmitter/receiver circuit and input/output circuit, contributing to decreasing the number of power source wires. It is, therefore, allowed to realize the motor current control circuit 10 in a compact size and, further, to decrease the number of parts and the cost.

Upon incorporating the three functions of the valve position calculator 71, motor angle controller 72 and motor driver 73 integrated on one-chip microcomputer and the function of the rotor position detector 65 in the cylindrical housing 37 of the brushless DC motor 1, further, it is allowed to eliminate the wire harness for coupling the rotor position detector 65, i.e., for coupling the three Hall ICs 65*u*, 65*v* and 65*w* to the valve position calculator 71 or to the motor driver 73, and to eliminate the transmitter/receiver circuit and the input/output circuit, making it possible to decrease the number of the power source lines. It is, therefore, made possible to further decrease the number of parts and the cost. Moreover, the rotor position detector 65, valve position calculator 71, motor angle controller 72 and motor driver 73 are integrated on a piece of circuit board 64 which is simply incorporated in the cylindrical housing 37 of the brushless DC motor 1 to finish the assembling of the sensors and the circuits facilitating the assembling.

Second Embodiment

Figure 9:
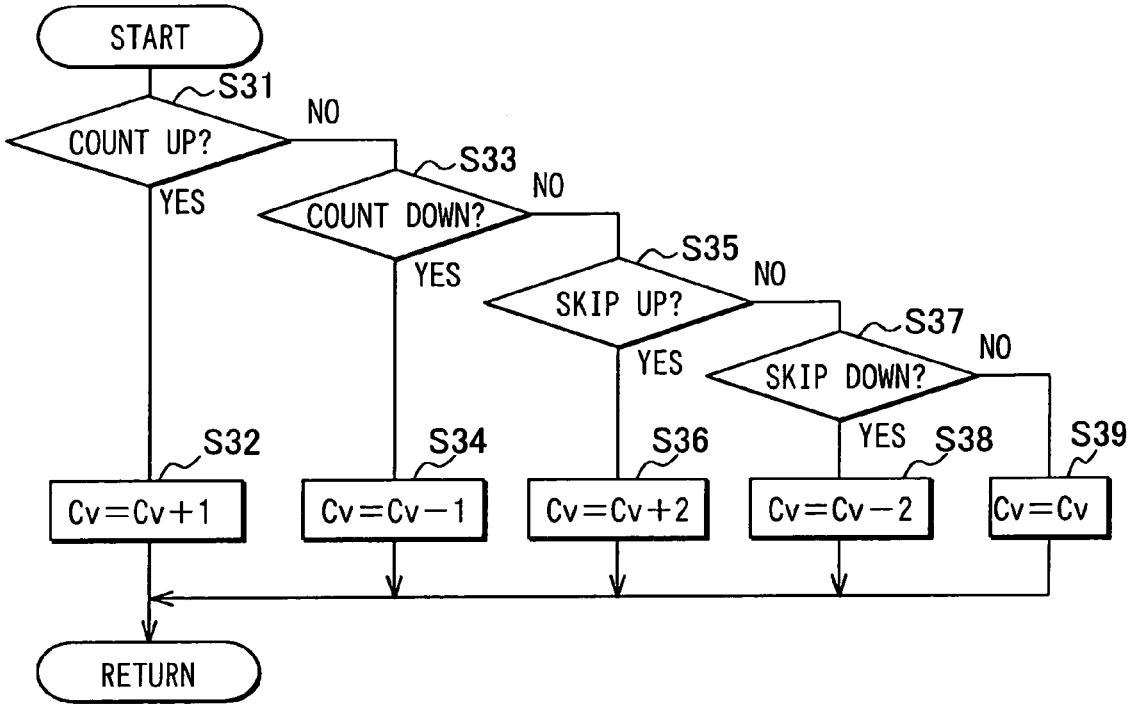
FIG. 9 is a flowchart illustrating a procedure for processing a valve position calculation (compensation for the count loss) (second embodiment)

FIGS. 8A, 8B and 9 illustrate a second embodiment of the present invention, wherein FIG. 8A is a diagram illustrating the outputs of the Hall ICs under the normal condition, and FIG. 8B is a diagram illustrating the outputs of the Hall ICs under a temporarily malfunctioning condition due to noise.

Here, in the throttle position controller disclosed in JP-A-6-94151 and in Japanese Patent No. 3070292, in case the shift of the output condition of the rotor position detecting means 104 is skipped due to noise or the like, there may occur a large difference between the valve position that is recognized of the throttle valve and the real valve position of the throttle valve if there is provided no means for compensating the skipping and if the valve position of the throttle valve is calculated based on a signal output from the rotor position detection means 104. Depending upon the cases, further, the emission will be adversely affected.

Further, considered below is a case where the output conditions of the three Hall ICs 65*u*, 65*v* and 65*w* shift in order of 1→2→3 accompanying the change in the rotational angle of the magnet rotor 8 of the brushless DC motor 1 as shown in FIG. 8. In detecting the condition 2, if the output value of the Hall IC 65*u* that should have been 1 becomes 0 being affected by noise, the valve position counter (Cv) is not updated when the condition shifts like 1→2 shown in the flowchart of FIG. 7, and is not counted up, either, even when the condition shifts like 1→3. Namely, there occur a total of two count losses. The condition is, further, skipped even in case the conditions shift at a speed very higher than the sampling period of the electric signals output from the three Hall ICs 65*u*, 65*v* and 65*w* due to the input of a large disturbance torque such as backfire. In this case, too, the count loss may occur.

Therefore, the valve position control device for the internal combustion engine of this embodiment is equipped with compensation means (flowchart of FIG. 9) for the count loss caused by noise applied to the electric signal (sensor output) output from any one of the three Hall ICs 65*u*, 65*v* and 65*w* or caused by a large disturbance torque such as backfire. The procedure for processing the valve position calculation (means for compensating the count loss) executed by the valve position calculator (valve position calculation means) 71 will now be described with reference to the flowchart of FIG. 9. The valve position calculation routine of FIG. 9 is repetitively executed at every predetermined timing after the ignition switch is turned on (IG ON). Further, the valve position calculation routine of FIG. 9 starts when the learn end flag (X1f) is 1. The processings same as those of the flowchart of FIG. 7 are denoted by the same reference numerals but their description is not repeated.

When the result determined at step S33 is NO, it is determined if the condition skip-up direction condition is holding at step S35. When the determined result is YES, the valve position counter (Cv) is skipped up at step S36. Thereafter, the procedure goes out of the valve position calculation routine of FIG. 9.

When the result determined at step S35 is NO, it is determined if the condition skip-down direction condition is holding at step S37. When the determined result is YES, the valve position counter (Cv) is skipped down at step S38. Thereafter, the procedure goes out of the valve position calculation routine of FIG. 9.

When the result determined at step S37 is NO, the valve position counter (Cv) is not varied. Namely, the present valve position counter (Cv) is maintained at step S39. Thereafter, the procedure goes out of the valve position calculation routine of FIG. 9.

In the valve position controller for the internal combustion engine of this embodiment as described above, the count number of the valve position counter (Cv) is increased or decreased by an amount that is skipped in case the shift of the condition of the electric signal (sensor output) from any one of the three Hall ICs 65*u*, 65*v*, 65*w* is skipped. By specifying the order of normal shifts of the condition, therefore, it is allowed to estimate the direction in which the magnet rotor 8 rotates and the amount of rotational angle (motor angle) even in case skip has occurred to a small degree improving the robustness against a large disturbance torque such as backfire and against the noise affecting the electric signal (sensor output) produced from any one of the three Hall ICs 65*u*, 65*v* and 65*w*. Therefore, it seldom happens to miss the counting of the number of shifts of the conditions of electric signals output from the three Hall ICs 65*u*, 65*v* and 65*w*, and it becomes little probable that a large difference occurs between the calculated valve position of the double-throw throttle valves 2 and the real valve position thereof preventing the emission from being adversely affected.

Third Embodiment

Figure 10:
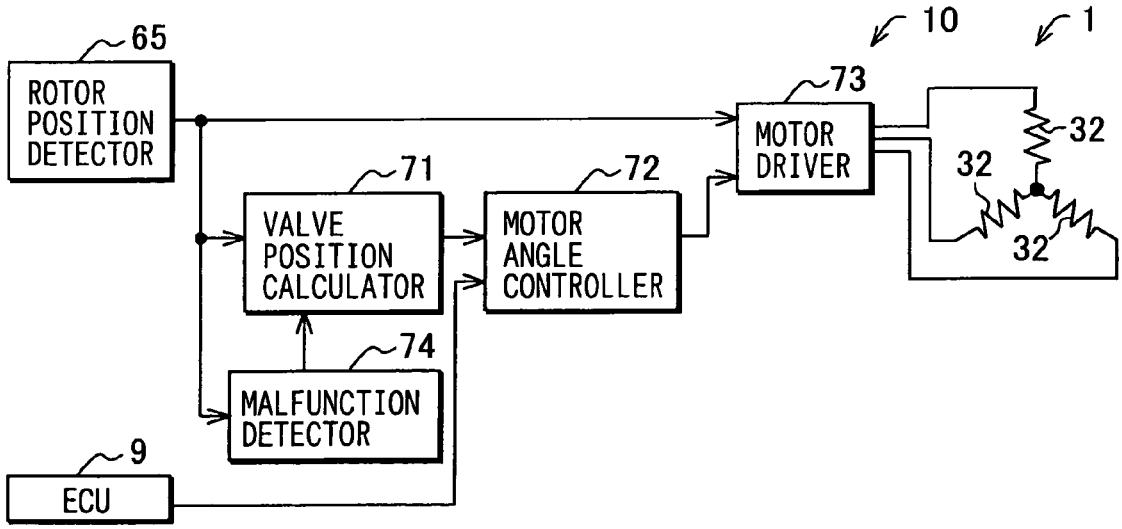
FIG. 10 is a diagram of constitution illustrating a control logic of a motor current control circuit having means for detecting the Hall ICs that are malfunctioning (third embodiment)
Figures 11, 12:
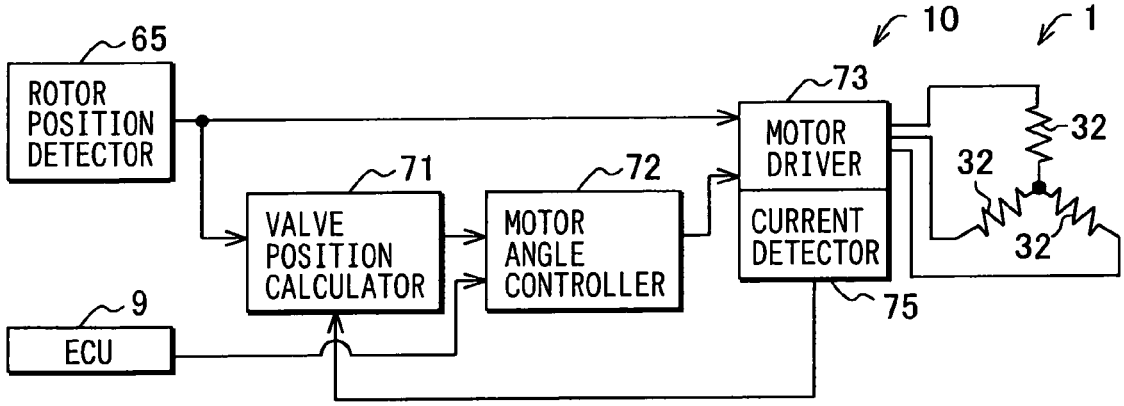
FIG. 11 is a diagram illustrating the outputs of the normal Hall ICs (third embodiment)
FIG. 12 is a diagram of constitution illustrating a control logic of the motor current control circuit having a current detector (fourth embodiment)

FIGS. 10 and 11 illustrate a third embodiment of the invention, wherein FIG. 10 is a diagram illustrating a control logic of a motor current control circuit having means for detecting the Hall IC that is malfunctioning, and FIG. 11 is a diagram illustrating the outputs of the normal Hall ICs.

In the valve position controller for the internal combustion engine of this embodiment, the three normal Hall ICs 65*u*, 65*v* and 65*w* can assume only six output conditions (six patterns) shown in FIG. 11, and the conditions {uvw}={000} and {uvw}={111} represent malfunctioning outputs or malfunctioning sensors. The motor current control circuit 10 of this embodiment has a malfunction detector 74 for detecting the malfunction (abnormal outputs or defective sensors) in the three Hall ICs 65*u*, 65*v* and 65*w* by detecting the signal conditions (ssta) output from the rotor position detector 65, i.e., by detecting malfunctioning conditions of the electric signals (sensor outputs) output from the three Hall ICs 65*u*, 65*v* and 65*w*.

Further, in case two or more conditions skip like 1→4 (conditions 2 and 3 or conditions 6 and 5 are skipped) as the shift of the signal conditions (ssta) output from the rotor position detector 65, i.e., as the shift of the conditions of the electric signals output from the three Hall IC's 65*u*, 65*v* and 65*w*, this condition is detected as a malfunctioning condition by the malfunctioning Hall IC detector 74, and a suitable processing is executed like leaning again the reference position learn control of the magnet rotor 8 shown in the flowcharts of FIGS. 5 and 6 to prevent adverse effect (worsened emission) upon the vehicle caused by the count miss. By detecting abnormal output conditions or abnormally shifting conditions of the three Hall ICs 65*u*, 65*v* and 65*w*, therefore, there is realized a highly reliable system.

The throttle position controllers disclosed in JP-A-6-94151 and in Japanese Patent No. 3070292 are capable of detecting which one of the rotor position detector 104 or the motor driver 107 is defective relying upon abnormal order of changing over the current, but are not capable of isolating them, with which a suitable countermeasure cannot be taken on the engine side or on the vehicle side in a case a trouble is detected. When the supply of current to the three-phase stator coils 103 of the brushless DC motor is discontinued, further, it is not allowed to detect abnormal condition in the rotor position detector 104 or in the motor driver 107.

Therefore, the malfunctioning Hall IC detector 74 of this embodiment includes a first malfunction discrimination means for discriminating whether the signal conditions (ssta) output from the rotor position detector 65, i.e., whether the conditions of the electric signals (sensor outputs) output from the three Hall ICs 65*u*, 65*v* and 65*w* are abnormal or normal, and a second malfunction discrimination means for discriminating whether the order of shift of the signal conditions (ssta) output from the rotor position detector 65, i.e., whether the order of shift of the conditions of electric signals (sensor outputs) output from the three Hall ICs 65*u*, 65*v* and 65*w* is abnormal or normal. By monitoring the signal conditions (ssta) output from the rotor position detector 65, i.e., by monitoring the electric signals (sensor outputs) output from the three Hall ICs 65*u*, 65*v* and 65*w*, therefore, the malfunctioning condition can be detected in the three Hall ICs 65*u*, 65*v* and 65*w* independently from the malfunctioning motor driver 73, making it possible to precisely detect the malfunctioning condition in the three Hall ICs 65*u*, 65*v* and 65*w*. Even when the supply of current to the three-phase stator coils 32 of the brushless DC motor 1 is interrupted, the malfunctioning condition can be detected in the three Hall ICs 65*u*, 65*v* and 65*w*.

Therefore, a highly reliable system is realized by detecting the malfunctioning conditions (malfunctioning output conditions of the three Hall ICs 65*u*, 65*v* and 65*w*) in the electric signals (sensor outputs) output from the three Hall ICs 65*u*, 65*v* and 65*w*, and by detecting abnormal shift of the conditions of the electric signals (sensor outputs) output from the three Hall ICs 65*u*, 65*v* and 65*w* (abnormal shift of the output conditions of the three Hall ICs 65*u*, 65*v* and 65*w*). Here, when it is determined by the malfunctioning IC detector 74 that the order of shift of the conditions of the electric signals (sensor outputs) output from the three Hall ICs 65*u*, 65*v* and 65*w* is not normal, a suitable processing is executed such as learning again the reference position learn control of the magnet rotor 8 illustrated in the flowcharts of FIGS. 5 and 6 to prevent the emission from being worsened by the mismatching of the real valve position and the calculated valve position of the double-throw throttle valves 2 caused by miss counting of the valve position counter (Cv) of the valve position calculator 71.

Fourth Embodiment

Figure 13:
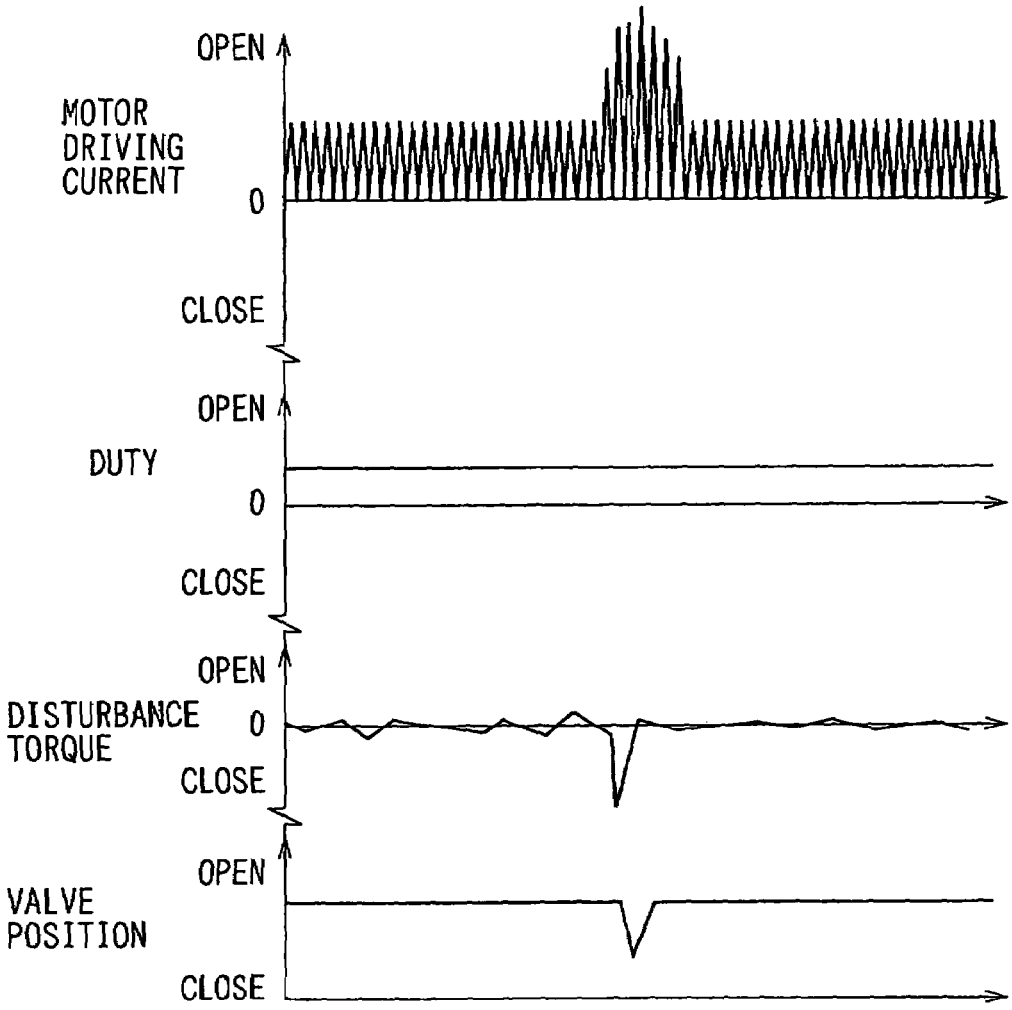
FIG. 13 is a diagram illustrating changes in the motor driving current, duty ratio, disturbance torque and valve position (fourth embodiment)

FIGS. 12 and 13 illustrate a fourth embodiment of the invention, wherein FIG. 12 is a diagram illustrating a control logic of a motor current control circuit having a current detector, and FIG. 13 is a diagram illustrating changes in the motor driving current, duty ratio, disturbance torque and valve position.

In the valve position controller for the internal combustion engine of this embodiment, a large disturbance torque may generate in the engine intake pipe communicated with the intake ports of the engine and, particularly, in the throttle bores 40 of the throttle body 4 due to the backfire (a phenomenon in which the combustion of a mixture is not completed during the combustion stroke in the combustion chamber in each cylinder of the engine, but lasts until the intake valve, which is for opening and closing the intake port of the cylinder of the engine, is opened in the next intake stroke). Due to the large disturbance torque, in this case, the double-throw throttle valves 2 turn at a high speed, whereby the signal conditions (ssta) output from the rotor position detector 65, i.e., the rate of change of the conditions of electric signals (sensor outputs) output from the three Hall ICs 65*u*, 65*v* and 65*w* become greater than the sampling speed, and the number of shifts of the conditions of electric signals (sensor outputs) output from the three Hall ICs 65*u*, 65*v* and 65*w* may be erroneously counted by the valve position counter (Cv) of the valve position calculator 71. To cope with this, if it is attempted to increase the speed for sampling the electric signals (sensor outputs) output from the three Hall ICs 65*u*, 65*v* and 65*w*, then, the sampling of a very high speed must be executed, boosting up the cost.

According to this embodiment, therefore, the motor current control circuit 10 is provided with a current detector (malfunction detector) 75 for detecting malfunctioning input which is very larger than the expected load torque based on a counter-electromotive force produced by the motor driving current flowing from the motor driver 73 into the three-phase stator coils 32 of the brushless DC motor 1. The current detector 75 is compensation means for compensating the count miss caused by a large disturbance torque. A counter-electromotive force generates on the three-phase stator coils 32 of the brushless DC motor 1 when the double-throw throttle valves 2 turn at a high speed due to the large disturbance torque. As a result, there occurs a change in the motor driving current flowing into the three-phase stator coils 32 of the brushless DC motor 1.

When the malfunctioning input which is very greater than the estimated load torque is detected in detecting the amount of change in the motor driving current by the current detector 75, i.e., when the amount of change in the motor driving current flowing into the three-phase stator coils 32 of the brushless DC motor 1 has exceeded a predetermined value, the reference position learn control for the magnet rotor 8 illustrated in the flowcharts of FIGS. 5 and 6 is learned again to eliminate the erroneous counting of the number of shifts of the conditions of electric signals (sensor outputs) output from the three Hall ICs 65*u*, 65*v* and 65*w*.

Even though the speed is not increased for sampling the electric signals (sensor outputs) output from the three Hall ICs 65*u*, 65*v* and 65*w*, the count miss for the number of shifts of the conditions of electric signals (sensor outputs) output from the three Hall ICs 65*u*, 65*v* and 65*w* can be eliminated without boosting up the cost. Further, by shortening the period (for receiving signals from the rotor position detector 65) for sampling the electric signals (sensor outputs) output from the three Hall ICs 65*u*, 65*v* and 65*w* to be very shorter than a minimum period for shifting the conditions of electric signals output from the three Hall ICs 65*u*, 65*v* and 65*w*, it is made possible to prevent the count miss of the number of shifts of the conditions of electric signals output from the three Hall ICs 65*u*, 65*v* and 65*w*, making it possible to detect the present position (valve position) of the double-throw throttle valves 2 maintaining high reliability.

Fifth Embodiment

Figure 14:
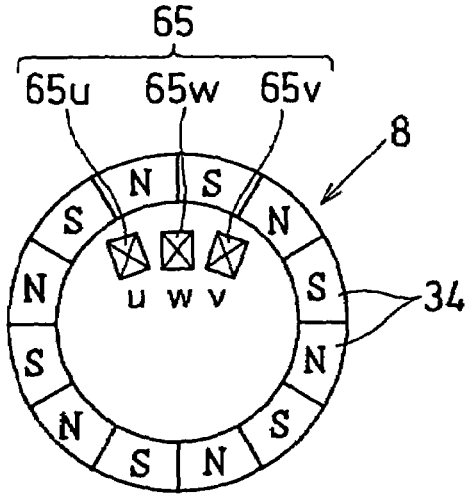
FIG. 14 is a diagram schematically illustrating a positional relationship between the magnet rotor and the three Hall ICs (fifth embodiment)
Figures 15A, 15B:
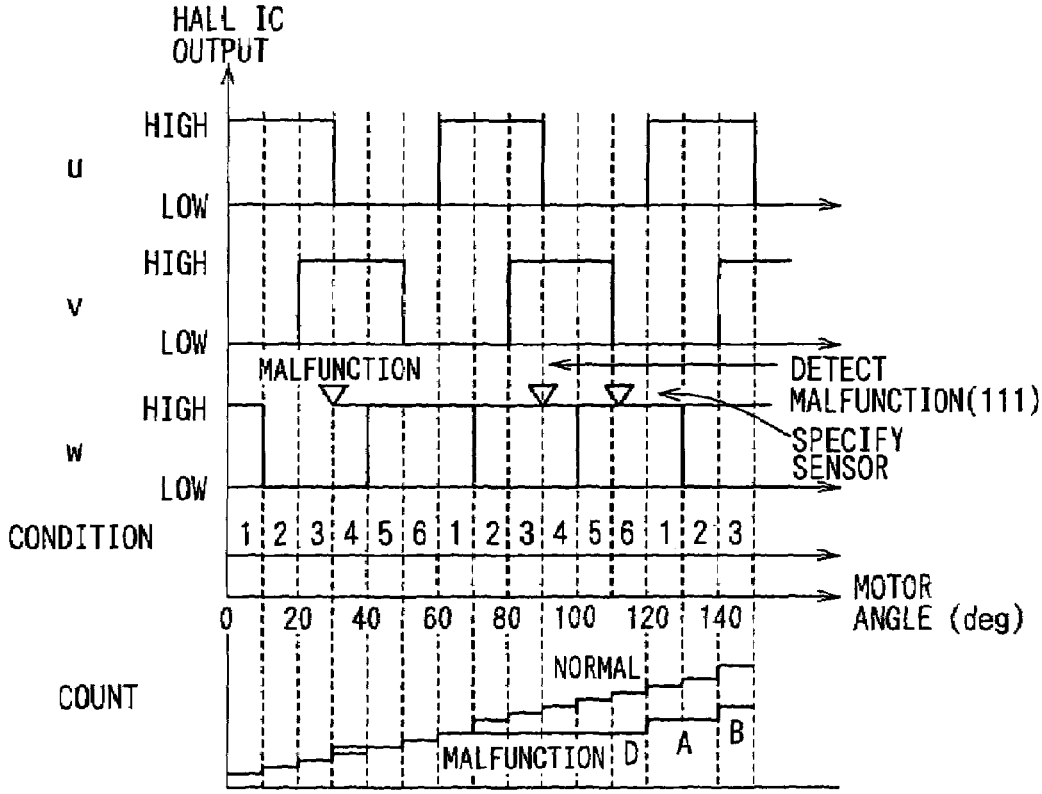
FIG. 15A is a timing chart illustrating the shifts of conditions of the Hall ICs relative the rotational angle of the motor and changes in the number of shifts of the conditions (counted number)
FIG. 15B is a diagram illustrating the outputs of the Hall ICs (fifth embodiment)
Figure 16:
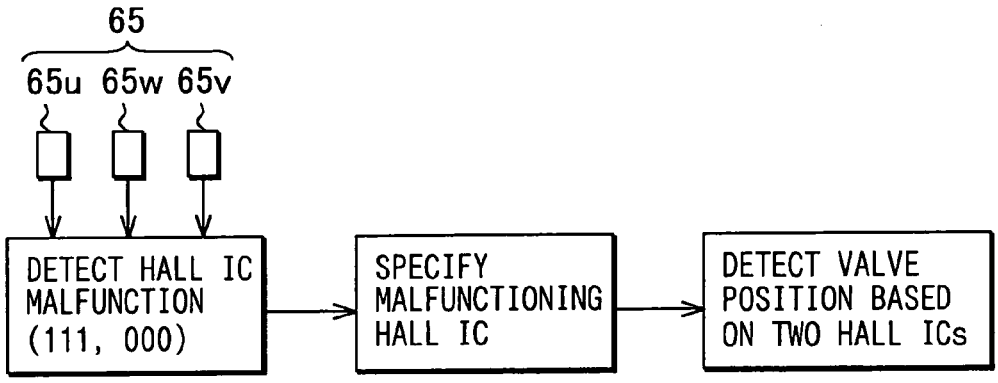
FIG. 16 is a diagram of constitution illustrating a control logic of a valve position calculator (fifth embodiment)

FIGS. 14 to 16 illustrate a fifth embodiment of the present invention, wherein FIG. 14 is a diagram illustrating a positional relationship between the magnet rotor and the three Hall ICs, FIG. 15A is a timing chart illustrating changes in the shift of the conditions of the Hall ICs relative to the motor rotational angle and in the number of shifts of the conditions (number counted), and FIG. 15B is a diagram illustrating the outputs of the Hall ICs. FIG. 16 is a diagram of a control logic illustrating a method of detecting the valve position of when the Hall IC is malfunctioning, that is executed by the valve position calculator (valve position calculation means) 71.

The rotor position detector (rotor position detection means) 65 of this embodiment comprises three Hall ICs 65*u*, 65*v* and 65*w* that are disposed maintaining a distance of, for example, 40 degrees in a direction in which the magnet rotor 8 rotates to generate an electromotive force upon sensing the magnetic field generated by permanent magnets 34 that are arranged in a number of twelve, and to produce output signals in response to the density of the magnetic flux that intersects them. Here, if one Hall IC 65*w* is malfunctioning being fixed to be high (high level) among the three Hall ICs 65*u*, 65*v* and 65*w*, the output that should be (110) in the condition 3 becomes (111).

As shown in the control logic of FIG. 16, therefore, the valve position calculator 71 judges that any one of the three Hall ICs 65*u*, 65*v* and 65*w* is malfunctioning when the output conditions of the three Hall ICs 65*u*, 65*v* and 65*w* are {uvw}={000}, {uvw}={111}. Described below is a case where one Hall IC 65*w* among the three Hall ICs 65*u*, 65*v* and 65*w* is malfunctioning being fixed to the high (high level). Here, the Hall IC 65*w* is the only sensor whose value does not change during the period of from condition 3 to condition 5. Therefore, the Hall IC 65*w* is specified to be malfunctioning (elimination method). Namely, at a moment (condition 5) when the conditions of electric signals output from the two Hall ICs 65*u* and 65*v* have shifted (value changes like high→low or low→high), the other Hall IC 65*w* that is malfunctioning is detected.

After the malfunctioning Hall IC is specified, the number of shifts of the conditions of electric signals output from the remaining two Hall ICs is counted disregarding the electric signals output from the malfunctioning Hall IC, and a throttle position (valve position) corresponding to the present position (rotational angle) of the double-throw throttle valves 2 is calculated (detected) based on the counted number. Concretely, at the time of the condition 6, the output conditions of the two Hall ICs 65*u* and 65*v* become {uv}={00} establishing the condition D of when the Hall IC 65*w* is malfunctioning. At the time of the condition 1 where the magnet rotor 8 of the brushless DC motor 1 has turned in the fully opening direction, the output conditions of the two Hall ICs 65*u* and 65*v* become {uv}={10} establishing the condition A of when the Hall IC 65*w* is malfunctioning. Even at the time of the condition 2 where the magnet rotor 8 of the brushless DC motor 1 has turned in the fully opening direction, the output conditions of the two Hall ICs 65*u* and 65*v* become {uv}={10} maintaining the condition A of when the Hall IC 65*w* is malfunctioning.

Further, at the time of the condition 3 where the magnet rotor 8 of the brushless DC motor 1 has turned in the fully opening direction, the output conditions of the two Hall ICs 65*u* and 65*v* become {uv}={11} establishing the condition B of when the Hall IC 65*w* is malfunctioning. Moreover, at the time of the condition 4 where the magnet rotor 8 of the brushless DC motor 1 has turned in the fully opening direction, the output conditions of the two Hall ICs 65*u* and 65*v* become {uv}={01} establishing the condition C of when the Hall IC 65*w* is malfunctioning. At the time of the condition 5 where the magnet rotor 8 of the brushless DC motor 1 has turned in the fully opening direction, too, the output conditions of the two Hall ICs 65*u* and 65*v* become {uv}={01} maintaining the condition C of when the Hall IC 65*w* is malfunctioning. Further, at the time of the condition 6 where the magnet rotor 8 of the brushless DC motor 1 has turned in the fully opening direction, the output conditions of the two Hall ICs 65*u* and 65*v* become {uv}={00} establishing the condition D of when the Hall IC 65*w* is malfunctioning.

As described above, while the magnet rotor 8 of the brushless DC motor 1 is turning in the fully opening direction, the valve position calculator 71 increases the valve position counter (Cv) by two (skips up 2) when the condition in the next turn has shifted like condition A→condition B or condition C→condition D. Further, the valve position counter (Cv) is increased by one (counted up by 1) when the condition has shifted in the next turn like condition B→condition C or condition D→condition A. Further, while the magnet rotor 8 of the brushless DC motor 1 is turning in the fully closing direction, the valve position calculator 71 decreases the valve position counter (Cv) by two (skips down 2) when the condition in the next turn has shifted like condition C→condition B or condition A→condition D. Further, the valve position counter (Cv) is decreased by one (counted down by 1) when the condition has shifted in the next turn like condition B→condition A or condition D→condition C.

When one Hall IC 65*w* among the three Hall ICs 65*u*, 65*v* and 65*w* is malfunctioning being fixed to the low (low level), the output condition that should be (001) under the condition 6 becomes (000). Therefore, when one Hall IC 65*w* is malfunctioning being fixed to the low (low level), too, the malfunctioning Hall IC can be specified like when one Hall IC 65*w* is malfunctioning being fixed to the high (high level). After the malfunctioning Hall IC is specified, the number of shifts of the conditions of electric signals output from the remaining two Hall ICs is counted disregarding the electric signals output from the malfunctioning Hall IC in the same manner as described above, and a throttle position (valve position) corresponding to the present position (rotational angle) of the double-throw throttle valves 2 is calculated (detected) based on the counted number.

In the valve position controller for the internal combustion engine according to this embodiment as described above, when any one of the three Hall ICs 65*u*, 65*v* and 65*w* is detected to be malfunctioning, the number of shifts of the conditions of electric signals output from the remaining two Hall ICs is counted to calculate the throttle position (valve position) that corresponds to the present position (rotational angle) of the double-throw throttle valves 2 avoiding such a situation that the present position (valve position) of the double-throw throttle valves 2 is lost simply because any one of the three Hall ICs 65*u*, 65*v* and 65*w* is malfunctioning. Even under the above situation, therefore, the valve position calculator 71 executes a suitable processing (counting the valve position counter (Cv)) based on the malfunctioning sensor data.

Sixth Embodime

Figure 17A:
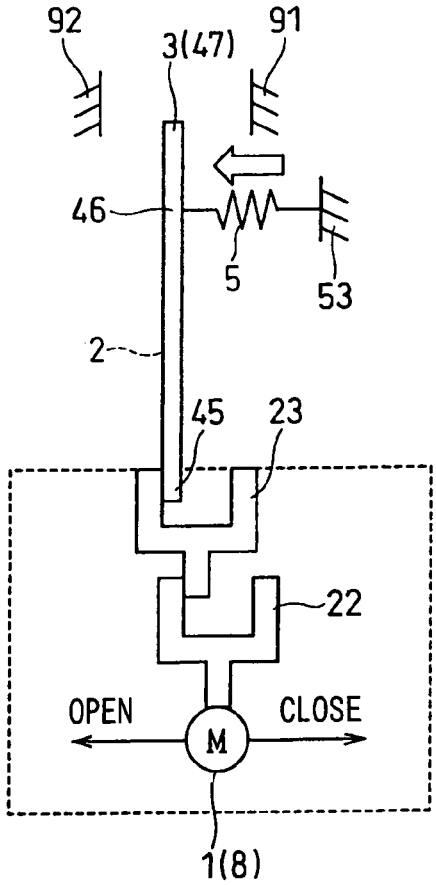
FIG. 17A is a diagram schematically illustrating a direction in which a return spring is urged during the normal operation.
Figure 17B:
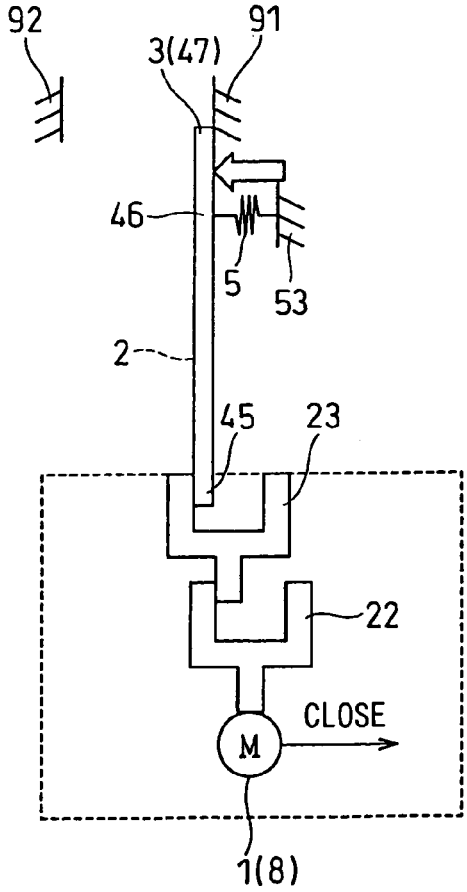
FIG. 17B is a diagram schematically illustrating a direction in which the return spring is urged during the reference position learn control operation (sixth embodiment)

FIG. 17 illustrates a sixth embodiment of the invention, wherein FIG. 17A is a diagram illustrating a direction in which a return spring is urged during the normal operation, and FIG. 17B is a diagram illustrating a direction in which the return spring is urged during the reference position learning control operation.

In the valve position controller for the internal combustion engine of this embodiment, a deviation may occur between the calculated valve position and the real valve position from the rotational position (rotational angle) of the magnet rotor 8 of the brushless DC motor 1 due to a gap (backlash) between the teeth surfaces of when the pinion gear is in mesh with a large gear 25 of the intermediate reduction gear 22, which are constituent elements of the reduction gear mechanism, due to a gap (backlash) between the teeth surfaces of when the small gear 26 of the intermediate reduction gear 22 is in mesh with the valve gear 23, i.e., due to the magnitude of play (backlash) of the reduction gears in the direction of rotation, due to the play of the coupling portion (valve shaft coupling portion) between the rotary shaft 27 of the valve gear 23 and the joint portion 45 of the valve shaft 3, and due to the play of the coupling portion (motor output shaft-coupling portion) between the motor shaft 11 of the brushless DC motor 1 and the pinion gear 21. Namely, a deviation may occur between the real valve position and the calculated value (calculated valve position) of the throttle position (valve position) corresponding to the present position (rotational angle) of the double-throw throttle valves 2 based on the number of shifts of the conditions of signals output from the three Hall ICs 65*u*, 65*v* and 65*w*.

Therefore, the valve position controller for the internal combustion engine of this embodiment is provided with a return spring 5 for urging the double-throw throttle valves 2 in a direction in which they are fully opened to bring the reduction gears into engagement with the motor output shaft-coupling portion at all times in one direction of the backlash and of the play. Namely, the reference position learn control is executed to learn the reference position of the magnet rotor 8 of the brushless DC motor 1 in a state where the double-throw throttle valves 2 are positioned at the valve position (idling position) at where they are abut to the mechanical stopper (full close stopper) 91 of the fully closed side that is against the urging force of the return spring 5. This makes it possible to eliminate the mismatching between the calculated valve position and the real valve position from the rotational position (rotational angle) of the magnet rotor 8 of the brushless DC motor 1 caused by the backlash among the reduction gears, play at the valve shaft-coupling portion and play at the motor output shaft-coupling portion. It is also allowable to provide the return spring 5 that urges the double-throw throttle valves 2 in the direction in which they are fully closed to bring the reduction gears into engagement with the motor output shaft-coupling portion at all times in one direction of the backlash and of the play, and execute the reference position learn control for learning the reference position of the magnet rotor 8 of the brushless DC motor 1 in a state where the double-throw throttle valves 2 are positioned at a valve position (idling position) where they are abut to the mechanical stopper (full open stopper) 92 of the fully opened side that is against the urging force of the return spring 5.

Seventh Embodiment

Figure 18:
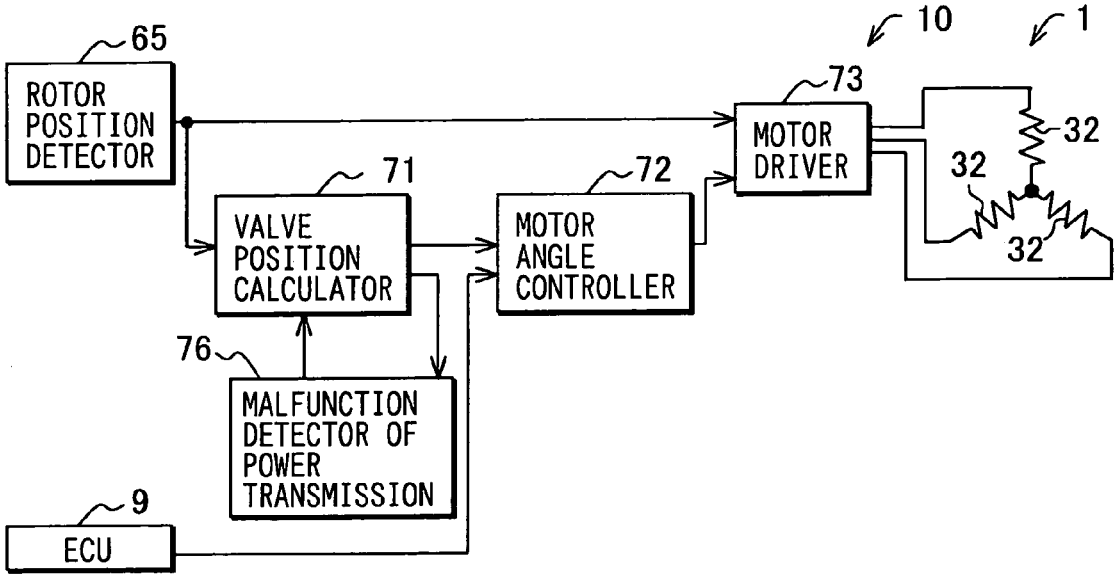
FIG. 18 is a diagram of constitution illustrating a control logic of a motor current control circuit having means for detecting the malfunction in the power transmission mechanism (seventh embodiment)

FIG. 18 is a diagram illustrating a control logic of a motor current control circuit having means for detecting the malfunction of the power transmission mechanism according to a seventh embodiment of the invention.

If there occurs a breakage (e.g., breakage of gear, abnormally increased backlash) in one or more of the reduction gears among the pinion gear 21, intermediate reduction gear 22 and valve gear 23 which are the elements constituting the reduction gear mechanism, in the coupling portion (valve shaft-coupling portion) between the rotary shaft 27 of the valve gear 23 and the joint portion 45 of the valve shaft 3, or in the coupling portion (motor output shaft-coupling portion) between the motor shaft 11 of the brushless DC motor 1 and the pinion gear 21 in the valve position controller for the internal combustion engine of this embodiment, mismatching occurs between the calculated valve position and the real valve position from the rotational position (rotational angle) of the magnet rotor 8 of the brushless DC motor 1. If the mismatching is left to stand, the emission may be adversely affected.

In this embodiment, therefore, the motor current control circuit 10 is provided with means 76 for detecting the malfunction of the power transmission mechanism to detect abnormal condition in the reduction gears, in the valve shaft-coupling portion and in the motor output shaft-coupling portion in case the counted number of the valve position counter (Cv) of the valve position calculator 71 deviates from a predetermined range (range in which the valve position can be counted), or in case the signal conditions (ssta) from the rotor position detector 65 are continuously shifting, i.e., in case the conditions of electric signals (sensor outputs) output from the three Hall ICs 65*u*, 65*v* and 65*w* are shifting for longer than a predetermined period of time (e.g., 200 msec) during the reference position learn control for learning the reference position of the magnet rotor 8 of the brushless DC motor 1.

Therefore, the malfunctioning condition is detected if a breakage (e.g., breakage of gear, abnormally increased backlash) occurs in the reduction gears, in the valve shaft-coupling portion or in the motor output shaft-coupling portion, and if mismatching occurs between the calculated valve position and the real valve position from the rotational position (rotational angle) of the magnet rotor 8 of the brushless DC motor 1. When the malfunction in the power transmission mechanism is detected from the rotational position (rotational angle) of the magnet rotor 8 of the brushless DC motor 1 that is lying outside the range, acoustic indication means such as buzzer or voice means is actuated or visual indication means such as an indicator lamp or character data is actuated promoting the driver to have the power transmission mechanism repaired or renewed, so that the mismatching between the calculated valve position and the real valve position from the rotational position (rotational angle) of the magnetic rotor 8 of the brushless DC motor 1 will not be left to stand and that the emission will not be adversely affected. Further, in case the malfunction in the power transmission mechanism is detected from the rotational position (rotational angle) of the magnet rotor 8 of the brushless DC motor 1 that is lying outside the range, a suitable procedure may be executed such as learning again the reference position learn control of the magnet rotor 8 illustrated in the flowcharts of FIGS. 5 and 6.

Eighth Embodiment

Figure 19:
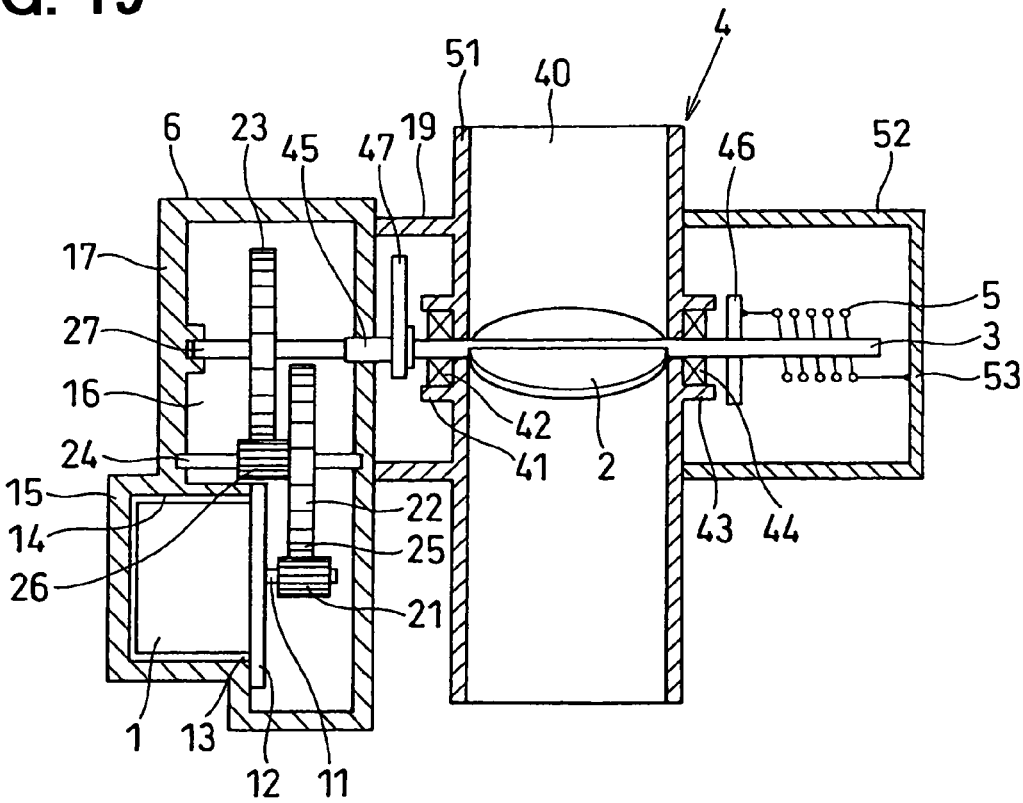
FIG. 19 is a sectional view schematically illustrating the constitution of a valve position controller for an internal combustion engine (eighth embodiment)
Figure 20:
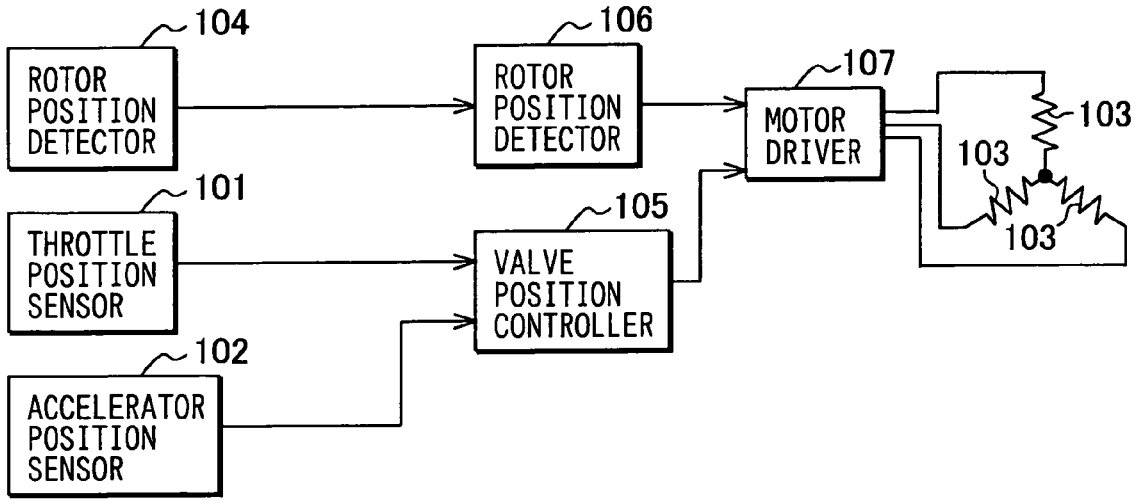
FIG. 20 PRIOR ART
FIG. 20 is a diagram of constitution illustrating a control logic of a throttle position controller (prior art).

FIG. 19 is a view schematically illustrating the constitution of a valve position controller for the internal combustion engine according to an eighth embodiment of the invention.

The valve position controller for the internal combustion engine of this embodiment includes a brushless DC motor 1 which is a drive source, a throttle valve 2 for adjusting the amount of the air taken into the combustion chambers of the cylinders of the engine, a valve shaft 3 that turns integrally with the throttle valve 2, a throttle body 4 for rotatably supporting the valve shaft 3, a return spring 5 for urging the throttle valve 2 in a direction in which it closes (or in a direction in which it opens), an ECU 9 for controlling the motor driving current fed to the three-phase stator coils 32 of the brushless DC motor 1 based on at least a throttle position signal from the accelerator position sensor 61, and a motor current control circuit 10 (a driving IC integrating three functions of the valve position calculator 71, motor angle controller 72 and motor driver 73 on the one-chip microcomputer). The throttle valve 2 may be in the form of a multi-throw throttle valves having not less than three valves.

Modified Embodiments

In this embodiment, the valve position controller of the invention is applied to the valve position controller for the internal combustion engine which controls the throttle position (valve position) corresponding to the rotational angle of the throttle valve 2 used in the throttle controller for the internal combustion engine by driving the brushless DC motor 1 depending upon the amount the accelerator pedal is depressed by the driver. However, the valve position controller of the invention may also be applied to the valve position controller for the internal combustion engine that controls the valve position of the multi-throw variable intake valves used for the variable intake system of the internal combustion engine. The variable intake valves are the air control valves for the internal combustion engine which varies the length or the sectional area of the intake passage of the intake manifold depending upon the rotational speed of the engine. The variable intake system for the internal combustion engine is a device for increasing the engine output shaft torque (engine torque) irrespective of the rotational speed of the engine by changing over the intake passage by using the valve bodies of the variable intake valves so as to lengthen the intake passage of the intake manifold when the engine is running in the low- to medium-speed regions, and by changing over the intake passage by using the valve bodies of the variable intake valves so as to shorten the length of the intake passage of the intake manifold when the engine is running in the high-speed region.

Further, the valve of the invention may be applied to the intake control valve which controls the amount of the air taken into the combustion chambers of the engine, to the exhaust control valve which controls the amount of the gas exhausted from the combustion chambers of the engine, to the idling speed control valve which controls the amount of the intake air by-passing the throttle valve, and to the exhaust gas recirculation control valve (EGR control valve) which controls the amount of the exhaust gas partly recirculated from the engine exhaust gas into the intake passage. The valve of the invention may be further applied to the intake air flow control valve such as a swirl control valve or a so-called swirl stream control valve that causes the intake air to produce a swirling stream in the transverse direction as it flows into the combustion chamber of the cylinder of the engine from the intake port of the engine. The valve of the invention may further be applied to the intake air stream control valve such as a tumble control valve or a so-called tumble stream control valve which causes the intake air to produce a swirling stream in the longitudinal direction as it flows into the combustion chamber of the cylinder of the engine from the intake port of the engine. In addition to the rotary valves such as the butterfly valves that are described above, the valve of the invention may further be applied to the poppet valves, shutter valves and door valves which are supported at the one side thereof only.

The above embodiments have dealt with the cases of using the three Hall ICs 65*u*, 65*v* and 65*w* integrating the Hall elements (noncontact-type magnetic detector elements) with the amplifier circuits, as noncontact-type magnetic detector elements (rotational angle sensors). As the noncontact-type magnetic detector elements (rotational angle sensors), however, there may be further used Hall elements alone or the reluctance elements. The noncontact-type magnetic detector elements (rotational angle sensors) may be arranged in a magnetic gap formed between a pair of magnetic members (yokes) that are magnetized by the permanent magnets. The noncontact-type magnetic detector elements may be provided in any number which is not smaller than 2 to detect the rotational position (motor rotational angle) and the rotational direction of the magnet rotor 8 of the brushless DC motor 1. Further, the brushless motor may be the one of the outer stator type (inner rotor type). Instead of the brushless DC (direct current) motor 1, further, there may be used a brushless AC (alternating current) motor 1 or an AC (alternating current) motor such as a three-phase induction motor.

What is claimed is:

1. A valve position controller comprising:

a brushless motor having three-phase stator coils constituting an armature winding, and a magnet rotor disposed so as to rotate relative to the stator coils and holding a plurality of permanent magnets for constituting field poles;

a valve driven by the brushless motor;

rotor position detection means for producing signals corresponding to the rotational position of the magnet rotor relative to the three-phase stator coils;

valve position calculation means for calculating the present position of the valve based on the signals output from the rotor position detection means;

control quantity calculation means for calculating the valve position control quantity to eliminate the difference between the present position of the valve calculated by the valve position calculation means and the target control value, and for calculating the motor current control quantity based on the calculated valve position control quantity; and a motor drive circuit for selectively driving the stator coils of two phases among the stator coils of the three phases based on signals output from the rotor position detection means and on the motor current control quantity calculated by the control quantity calculation means.

2. A valve position controller according to claim 1, wherein the motor current control quantity includes the duty ratio and the direction of current or includes the amount of current and the direction of current of the motor driving current fed to the stator coils of two phases among the three-phase stator coils, which is set to eliminate the difference between the present position of the valve calculated by the valve position calculation means and the target control value.

3. A valve position controller according to claim 1, wherein the rotor position detection means has noncontact-type magnetic detector elements that generate an electromotive force upon sensing a magnetic field generated by the plurality of permanent magnets, or produce electric signals corresponding to the density of a magnetic flux that intersects; and the magnetic detector elements are arranged in a plural number so as to face the magnet rotor.

4. A valve position controller according to claim 3, wherein the valve position calculation means has a counter for counting the number of shifts of the conditions of electric signals output from the magnetic detector elements; and the present position of the valve is calculated based on the counted number of the counter.

5. A valve position controller according to claim 4, wherein when the shifts of the states of electric signals output from the magnetic detector elements are skipped, the valve position calculation means increases or decreases the counted number of the counter by an amount that is skipped.

6. A valve position controller according to claim 4, further comprising:

first malfunction discrimination means for discriminating whether the conditions of electric signals output from the magnetic detector elements are abnormal or normal; and second malfunction discrimination means for discriminating whether the order of shifts of the conditions of electric signals output from the magnetic detector elements is abnormal or normal, wherein when the order of shifts of the conditions of electric signals output from the magnetic detector elements is determined by the second malfunction discrimination means to be abnormal, the valve position calculation means executes again or learns again the reference position learn control to learn the reference position of the magnet rotor.

7. A valve position controller according to claim 1, further comprising:

malfunction detection means for detecting abnormal input that greatly exceeds an estimated load torque based on a counter electromotive force produced by the motor driving current flowing into the three-phase stator coils, wherein, when the abnormal input greatly exceeding the estimated load torque is detected by the malfunction detection means, the valve position calculation means executes again or learns again the reference position learn control to learn the reference position of the magnet rotor.

8. A valve position controller according to claim 4, further comprising:

a power transmission mechanism for transmitting the rotational output of the brushless motor to the valve; and malfunction detection means for detecting the malfunction in the power transmission mechanism when the counted number of the counter is deviated from the predetermined range or when the electric signals output from the magnetic detector elements continue to shift the conditions for longer than a predetermined period of time during the reference position learn control for learning the reference position of the magnet rotor.

9. A valve position controller according to claim 3, wherein the valve position calculation means shortens the period for sampling the electric signals output from the magnetic detector elements to be shorter than a minimum period of shift of the conditions of electric signals output from the magnetic detector elements.

10. A valve position controller according to claim 1, wherein the rotor position detection means includes three magnetic detector elements that generate an electromotive force upon sensing a magnetic field generated by the plurality of permanent magnets, or produce electric signals corresponding to the density of a magnetic flux that intersects; and when one magnetic detector element is detected to be malfunctioning among the three magnetic detector elements, the valve position calculation means counts the number of shifts of the conditions of electric signals output from the remaining two magnetic detector elements to calculate the present position of the valve.

11. A valve position controller according to claim 1, wherein at least two or more functions of the valve position calculation means, the control quantity calculation means, and the motor drive circuit are integrated on one chip.

12. A valve position controller according to claim 11, wherein the brushless motor has a motor shaft that is integral with the magnet rotor, and a cylindrical motor housing that rotatably supports both ends of the motor shaft in the axial direction; and at least two or more functions of the valve position calculation means, the control quantity calculation means and the motor drive circuit integrated on one chip, as well as the function of the rotor position detection means, are contained in the motor housing.

13. A valve position controller according to claim 1, further comprising:

a reduction gear mechanism which reduces the rotational speed of the magnet rotor by a predetermined reduction ratio and transmits it to the valve, and a spring for urging the valve in a direction in which it opens or in a direction in which it closes, wherein the valve position calculation means executes a reference position learn control to learn the reference position of the magnet rotor in a state where the valve is positioned in a direction against the urging direction of the spring.

14. A valve position controller according to claim 1, further comprising a valve housing forming an air passage through which the air flows, wherein the valve is a flow rate control valve for controlling the flow rate of the air that flows through the air passage.

15. A valve position controller according to claim 1, further comprising a valve housing forming an intake air passage communicated with the intake ports of an internal combustion engine, wherein the valve is an air control valve that produces a swirling stream of the air flowing into the combustion chamber from the intake port of the internal combustion engine.

16. A valve position controller according to claim 1, further comprising an intake manifold forming an intake air passage communicated with the combustion chambers of an internal combustion engine, wherein the valve is a variable intake valve which opens and closes the intake air passage to vary the length or the opening area of the intake air passage.

17. A valve position controller according to claim 1, further comprising a throttle body forming a throttle bore of a circular shape in cross section communicated with the combustion chambers of an internal combustion engine, wherein the valve is a disk-shaped throttle valve for adjusting the amount of the intake air flowing through the throttle bore.

* * * * *